US012796779B2

(12) United States Patent
Bock et al.

(10) Patent No.: US 12,796,779 B2
(45) Date of Patent: Nov. 17, 2026

(54) ARTICLE OF FOOTWEAR HAVING A KNITTED UPPER

(71) Applicant: PUMA SE, Herzogenaurach (DE)

(72) Inventors: Markus Bock, Herzogenaurach (DE); Andreas Siegismund, Rückersdorf (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 18/975,249

(22) Filed: Dec. 10, 2024

(65) Prior Publication Data

US 2025/0098819 A1 Mar. 27, 2025

Related U.S. Application Data

(63) Continuation of application No. 17/575,011, filed on Jan. 13, 2022, now Pat. No. 12,201,187.

(60) Provisional application No. 63/137,903, filed on Jan. 15, 2021.

(51) Int. Cl.

| | |
|---|---|
| ***A43B 23/02*** | (2006.01) |
| ***A43B 1/02*** | (2022.01) |
| ***A43B 1/04*** | (2022.01) |

(52) U.S. Cl.

CPC ..... *A43B 23/025* (2013.01); *A43B 1/02* (2013.01); *A43B 1/04* (2013.01); *A43B 23/021* (2013.01)

(58) Field of Classification Search

CPC ... A43B 23/025; A43B 23/021; A43B 1/0027; A43B 23/022; A43B 23/0235; A43B 23/0265; A43B 23/085; A43B 23/088; A43B 23/14; A43B 1/04; D10B 2403/0112; D10B 2501/043; D04B 21/06

See application file for complete search history.

(56) References Cited

U.S. PATENT DOCUMENTS

| | | | | |
|---|---|---|---|---|
| 5,946,825 | A * | 9/1999 | Koh | A43B 23/028 36/55 |
| 11,624,134 | B2 * | 4/2023 | Bartys | D04B 1/24 36/84 |
| 2007/0056491 | A1 | 3/2007 | Yasuzawa | |
| 2007/0180730 | A1 | 8/2007 | Greene et al. | |
| 2008/0110048 | A1 | 5/2008 | Dua et al. | |

(Continued)

FOREIGN PATENT DOCUMENTS

| | | |
|---|---|---|
| CN | 104146426 A | 6/2017 |
| EP | 2792265 A2 | 10/2014 |

(Continued)

OTHER PUBLICATIONS

PCT International Search Report and Written Opinion, PCT/IB2022/050270, May 25, 2022, 18 pages.

*Primary Examiner* — Alissa L Hoey

*Assistant Examiner* — Akwokwo Olabisi Redhead

(74) *Attorney, Agent, or Firm* — Quarles & Brady, LLP

(57) ABSTRACT

An article of footwear defining a forefoot region, a midfoot region, a heel region, a lateral side, and a medial side includes an upper, a heel element, and a sole structure. The upper includes an outer surface, and the heel element is secured to the upper proximate to the heel region. The upper includes a knit fabric forming a first knit zone having a first elasticity, a second knit zone having a second elasticity, and a third knit zone having a third elasticity. Each of the first elasticity, the second elasticity, and the third elasticity are different.

19 Claims, 18 Drawing Sheets

(56) References Cited

U.S. PATENT DOCUMENTS

| | | | | |
|---|---|---|---|---|
| 2014/0130376 | A1 | 5/2014 | Fahmi et al. | |
| 2014/0150292 | A1 | 6/2014 | Podhajny et al. | |
| 2014/0352173 | A1 | 12/2014 | Bell et al. | |
| 2015/0007451 | A1 | 1/2015 | Bruce | |
| 2015/0272274 | A1* | 10/2015 | Berns | A43B 23/0265 36/84 |
| 2017/0238644 | A1* | 8/2017 | Meir | D04B 1/126 |
| 2018/0020763 | A1* | 1/2018 | Hipp | A43B 1/04 36/47 |
| 2019/0037967 | A1 | 2/2019 | McFarland, II et al. | |
| 2020/0205517 | A1 | 7/2020 | Happen | |
| 2022/0298683 | A1* | 9/2022 | Bartys | A43B 23/025 |
| 2022/0333286 | A1* | 10/2022 | Mcginnity | A43B 23/027 |
| 2023/0130760 | A1* | 4/2023 | Frazier | A43B 1/028 36/30 A |

FOREIGN PATENT DOCUMENTS

| | | | | |
|---|---|---|---|---|
| WO | 2017044313 | A1 | 3/2017 | |
| WO | 2018144123 | A1 | 8/2018 | |
| WO | WO-2019206423 | A1 * | 10/2019 | A43C 1/003 |

* cited by examiner

ARTICLE OF FOOTWEAR HAVING A KNITTED UPPER

CROSS REFERENCE TO RELATED APPLICATIONS

This application is a continuation of U.S. application Ser. No. 17/575,011, filed on Jan. 13, 2022, which claims the benefit of and priority to U.S. Provisional Application Ser. No. 63/137,903, filed on Jan. 15, 2021, each of which are incorporated by reference herein in their entirety and are to be considered part of this application.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear having multiple zones of knitted material.

2. Description of the Background

Many conventional shoes or articles of footwear generally comprise an upper and a sole attached to a lower end of the upper. Conventional shoes further include an internal space, i.e., a void or cavity, which is created by interior surfaces of the upper and sole, and receives a foot of a wearer before securing the shoe to the foot. The sole is attached to a lower surface of the upper and is positioned between the upper and the ground. As a result, the sole typically provides stability and cushioning to the wearer when the shoe is being worn and/or is in use. In some instances, the sole may include multiple components, such as an outsole, a midsole, and an insole. The outsole may provide traction to a bottom surface of the sole, and the midsole may be attached to an inner surface of the outsole and may provide cushioning and/or added stability to the sole. For example, a sole may include a particular foam material that may increase stability at one or more desired locations along the sole, or a foam material that may reduce stress or impact energy on the foot and/or leg during running, walking, or another activity.

The upper generally extends upward from the sole and defines an interior cavity that completely or partially encases a foot. In most cases, an upper extends over instep and toe regions of the foot, and across medial and lateral sides thereof. Many articles of footwear may also include a tongue that extends across the instep region to bridge a gap between edges of the upper that define an opening into the cavity. The tongue may also be provided below a lacing system, which may be provided to allow for adjustment of shoe tightness, and may be manipulable by a user to permit entry and/or exit of a foot from the internal space or cavity. In addition, the lacing system may allow a wearer to adjust certain dimensions of the upper and/or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

In many cases, articles of footwear having uppers with an increased comfort and better fit are desired, along with soles having improved cushioning systems or structural characteristics. Some articles of footwear may include regions of enhanced stability which can be provided by using different textile constructions or compositions. For example, knitting is commonly used to create uppers for articles of footwear. To create regions of enhanced stability, regions of the upper may include denser knitting constructions, different materials, or varying knitting or weaving techniques, such as, e.g., ribs. Often woven materials are used to create uppers. To create regions of enhanced stability in a woven or knitted upper, regions may include a denser weave or knit, higher denier yarns, or incorporate different materials.

SUMMARY

An article of footwear, as described herein, may have various configurations. The article of footwear can include an upper, a heel element, a sole structure, a medial side, and a lateral side. The upper can include an outer surface that defines a forefoot region, a midfoot region, and a heel region. The upper can include a membrane layer and a material layer. The material layer can include a knit fabric and defines a first knit zone and a second knit zone. The first knit zone has a tighter knit than the second knit zone.

Some embodiments of the invention provide an article of footwear. The article of footwear can include an upper with an outer surface that defines a forefoot region, a midfoot region, and a heel region. A heel element can be secured to the upper proximate to a heel region. The article of footwear can also include a sole structure, a medial side, and a lateral side. The upper can include a membrane layer and a material layer. The material layer can include a knit fabric that defines at least a first knit zone and a second knit zone.

In some embodiments, an article of footwear can include a third knit zone.

In some embodiments, an article of footwear can include a first knit zone disposed within a forefoot region, a second knit zone disposed within a midfoot region, and a third knit zone disposed within a heel region.

In some embodiments, an article of footwear can include a first knit zone formed from a tighter knit than a second knit zone and a third knit zone.

In some embodiments, an article of footwear can include a second knit zone formed from a looser knit than a first knit zone and a third knit zone.

In some embodiments, an article of footwear can include a first knit zone formed from a first thread having a first thread diameter, a second knit zone formed from a second thread having a second thread diameter, and a third knit zone formed from a third thread having a third thread diameter. Each of the first diameter, the second diameter, and the third diameter can be different.

In some embodiments, an article of footwear can include a first knit zone formed from a first thread having a first color, a second knit zone formed from a second thread having a second color, and a third knit zone formed from a third thread having a third color. Each of the first color, the second color, and the third color can be different.

In some embodiments, an article of footwear can include a first knit zone having a first elasticity, a second knit zone having a second elasticity, and a third knit zone having a third elasticity. Each of the first elasticity, the second elasticity, and the third elasticity can be different.

In some embodiments, an article of footwear can include a plurality of knit zones. The loosest knit zone may be disposed within a midfoot region of the article of footwear.

In some embodiments, an article of footwear can include an upper having a thermoplastic polyurethane (TPU) skin layer that is secured to a material layer. The TPU skin layer can have a tint that is between 10% and 30%.

In some embodiments, an article of footwear can include a vamp assembly secured to an upper. The vamp assembly can include a toe portion, a vamp body portion, and a tongue portion.

In some embodiments, an article of footwear can include a toe portion formed from leather and stitched to a vamp body portion.

In some embodiments, an article footwear can include a vamp assembly loosely secured to an upper so that laces can thread underneath a tongue portion of the vamp assembly.

In some embodiments, an article of footwear can include a heel element configured as a single piece of leather.

Some embodiments of the invention provide an article of footwear having an upper with an outer surface that defines a forefoot region, a midfoot region, and a heel region. A heel element can be secured to the upper proximate to a heel region. The article of footwear can also include a sole structure, a medial side, and a lateral side. The upper can include a knit fabric forming a first knit zone having a first elasticity, a second knit zone having a second elasticity, and a third zone having a third elasticity. Each of the first elasticity, the second elasticity, and the third elasticity can be different.

In some embodiments, an article of footwear can include a first knit zone, a second knit zone, and a third knit zone. Each of which (or combinations thereof) may be integrally formed.

In some embodiments, an article of footwear can include a first knit zone disposed within a forefoot region, a second knit zone disposed within a midfoot region, and a third knit zone disposed within a heel region. An elasticity of the second knit zone may be greater than an elasticity of a third knit zone.

In some embodiments, an article of footwear can include a first knit zone disposed within a forefoot region, a second knit zone disposed within a midfoot region, and a third knit zone disposed within a heel region. A breathability of the first region and the second region may be greater than a breathability of a third region such that moisture at a given temperature and pressure may pass through the first and second regions while not being able to pass through the third region.

In some embodiments, an article of footwear can include a membrane layer configured as a one-way membrane so that moisture can be transferred only from an inside of the article of footwear to an outside of an article of footwear while preventing moisture from entering the inside of the article of footwear from the outside of the article of footwear.

Some embodiments of the invention provide a method for producing an upper for an article of footwear. The upper can define a forefoot region, a midfoot region, and a heel region. The method can include forming a first knit zone in the forefoot region having a first elasticity, forming a second knit zone in the midfoot region having a second elasticity, and forming a third knit zone in the heel region having a third elasticity. The method can also include securing a membrane layer to each of the first knit zone, the second knit zone, and the third knit zone.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
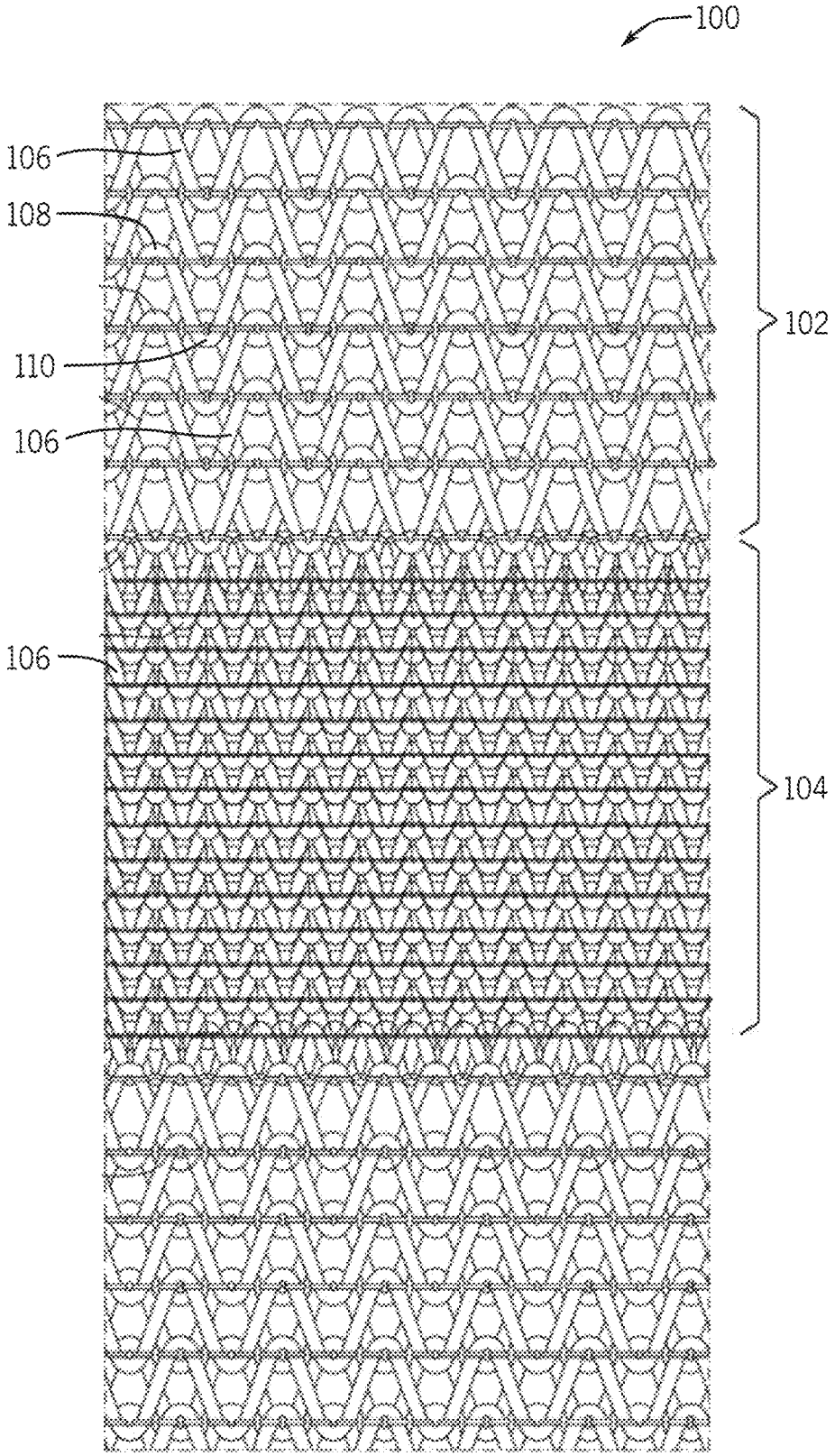
FIG. 1 is a schematic illustration of an example fabric knit.

The following discussion and accompanying figures disclose various embodiments or configurations of a shoe that may include an upper and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%."

The present disclosure is directed to an article of footwear and/or specific components of the article of footwear, such as an upper and/or a sole or sole structure. The upper may comprise a knitted component. The knitted component may be made by knitting of yarn or shoe laces, for example. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. The upper may comprise a variety of materials, such as a first yarn, a second yarn, and/or a third yarn, which may have varying properties or varying visual characteristics.

As discussed above, some articles of footwear can include regions of enhanced stability. Certain regions of the upper may include denser knitting constructions, different materials, or varying knitting techniques. Often woven materials are used to create uppers. To create regions of enhanced stability in a woven or knitted upper, regions may include a denser weave or knit, higher denier yarns, or incorporate different materials.

For uppers comprising knit and/or woven materials, a common technique for enhancing stability in particular regions or zones includes adding thermoplastic layers, i.e., skin, onto a surface of the material. However, conventional methods of manufacturing uppers with a plurality of performance characteristics can require lengthy manufacturing timelines. Additionally, conventional manufacturing methods can limit opportunities for experimentation and increased incremental design changes. That is, making minor modifications to an article of footwear may require substantial changes to the manufacturing mechanism.

Figure 2:
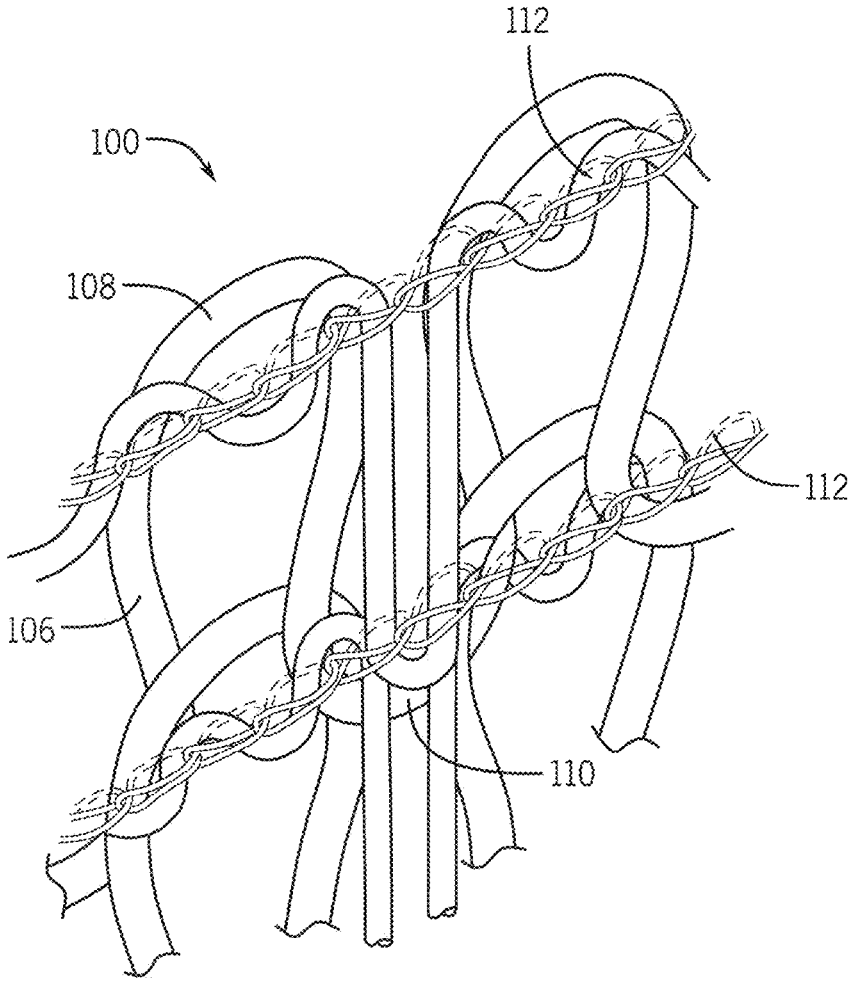
FIG. 2 is a detailed schematic illustration of an example fabric knit.
Figure 3:
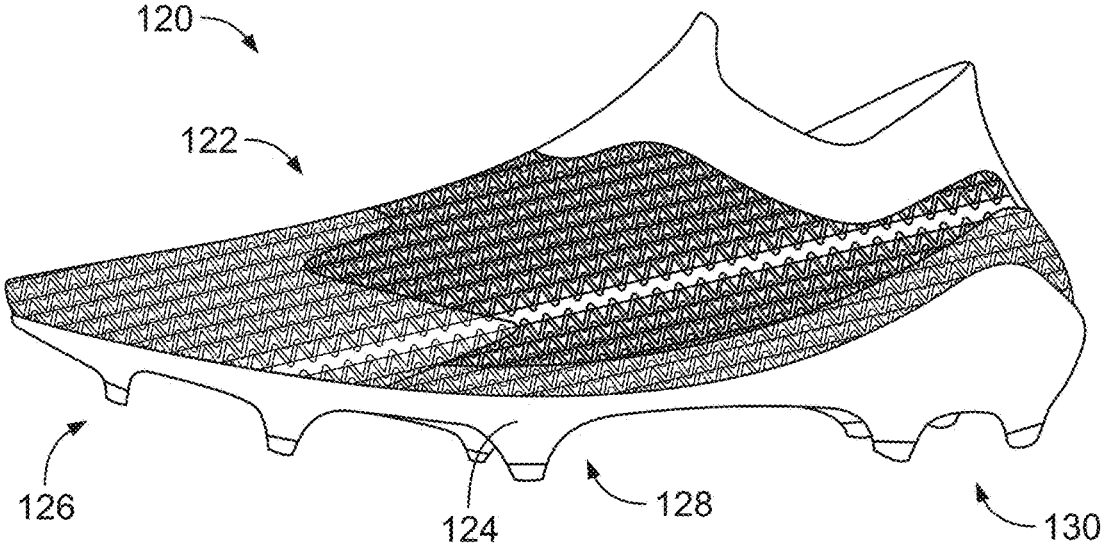
FIG. 3 is a left side elevational view of an article of footwear according to some embodiments of the present disclosure.

FIGS. 1 and 2 illustrate an example of a knit material 100. The material 100 includes at least a first region 102 and a second region 104, illustrated in FIG. 1, for example. Each of the first region 102 and the second region includes webbing 106 that forms a warp knit within the material 100. The webbing 106 is woven from a plurality of woven threads. The knit includes a plurality of peaks 108 and troughs 110. The webbing 106 is positioned in a wave-like orientation so that the peaks 108 are positioned between troughs 110 of the webbing 106. The structure and pattern of the waves are repeated to create a continuous piece of fabric. In the illustrated example of FIG. 1, the second region 104 is denser than the first region 102. In particular, the peaks 108 and troughs 110 of a single line of webbing 106 are closer together in the second region 104 relative to the first region 102.

In other embodiments, first and second webbings may be placed in a wave-like orientation so that a peak of the first webbing is positioned between two peaks of a second webbing. In some embodiments, the knit structure can be secured with at least one binding line or wire. For example, FIG. 2 illustrates an exemplary embodiment of an orientation of the webbing 106 of a knit. The knit includes a binding line 112 around which the webbing 106 can be woven at the peaks 108 and the troughs 110. The distance between the binding line 112 can be increased or decreased to vary the density of the material 100 in a single piece of fabric.

FIGS. 3-6 depict an exemplary embodiment of an article of footwear 120 including an upper 122 and a sole structure 124. As will be further discussed herein, the upper 122 is attached to the sole structure 124 and together define an interior cavity into which a foot may be inserted. For reference, the article of footwear 120 defines a forefoot region 126, a midfoot region 128, and a heel region 130 (see, for example, FIG. 6). The forefoot region 126 generally corresponds with portions of the article of footwear 120 that encase portions of the foot that include the toes, the ball of the foot, and joints connecting the metatarsals with the toes or phalanges. The midfoot region 128 is proximate and adjoining the forefoot region 126, and generally corresponds with portions of the article of footwear 120 that encase the arch of a foot, along with the bridge of a foot. The heel region 130 is proximate and adjoining the midfoot region 128 and generally corresponds with portions of the article of footwear 120 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 122 of the article of footwear 120 is formed from a knitted structure or knitted components. In various embodiments, a knitted component may incorporate various types of yarn that may provide different properties to an upper. For example, one area of the upper 122 may be formed from a first type of yarn that imparts a first set of properties, and another area of the upper 122 may be formed from a second type of yarn that imparts a second set of properties. Using this configuration, properties of the upper 122 may vary throughout the upper 122 by selecting specific yarns for different areas of the upper 122.

The specific properties that a particular type of yarn will impart to an area of a knitted component may partially depend on the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 122.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 122 may also include additional structural elements. For example, in some embodiments, a heel element 132 may be provided on the heel region 130 to provide added support to a heel of a user. In some instances, other elements (e.g., plastic material, logos, trademarks, etc.) may also be applied and fixed to an exterior surface using glue or a thermoforming process. In some embodiments, the properties associated with the upper 122, e.g., a stitch type, a yarn type, or characteristics associated with different stitch types or yarn types, such as elasticity, aesthetic appearance, thickness, air permeability, or scuff-resistance, may be varied.

Figure 4:
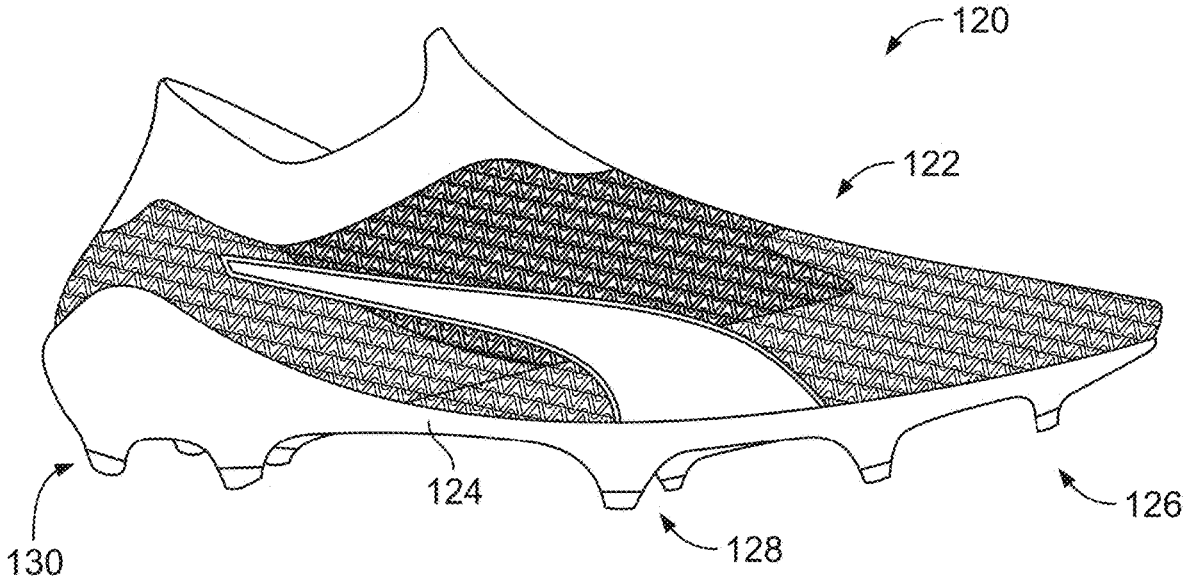
FIG. 4 is a right side elevational view of the article of footwear of FIG. 3.
Figure 6:
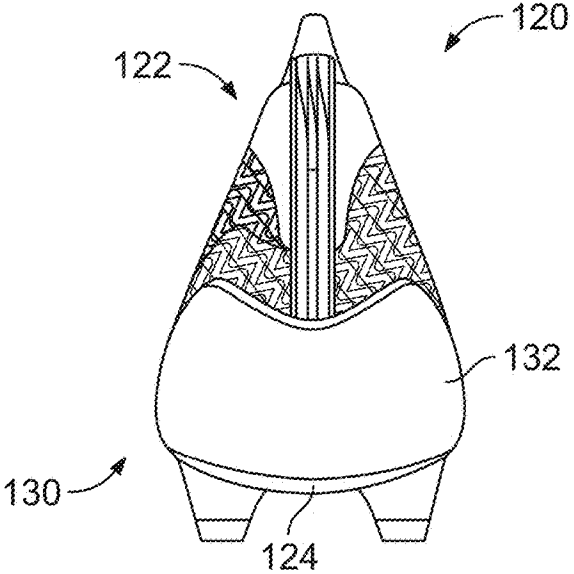
FIG. 6 is a rear elevation view of the article of footwear of FIG. 3.

The article of footwear 120 includes a medial side (see FIG. 3) and a lateral side (see FIG. 4). In particular, the lateral side corresponds to an outside portion of the article of footwear 120 and the medial side corresponds to an inside portion of the article of footwear 120. As such, left and right articles of footwear have opposing lateral and medial sides, such that the medial sides are closest to one another when a user is wearing the articles of footwear 120, while the lateral sides are defined as the sides that are farthest from one another while being worn. As will be discussed in greater detail below, the medial side and the lateral side adjoin one another at opposing, distal ends of the article of footwear 120.

Figure 5:
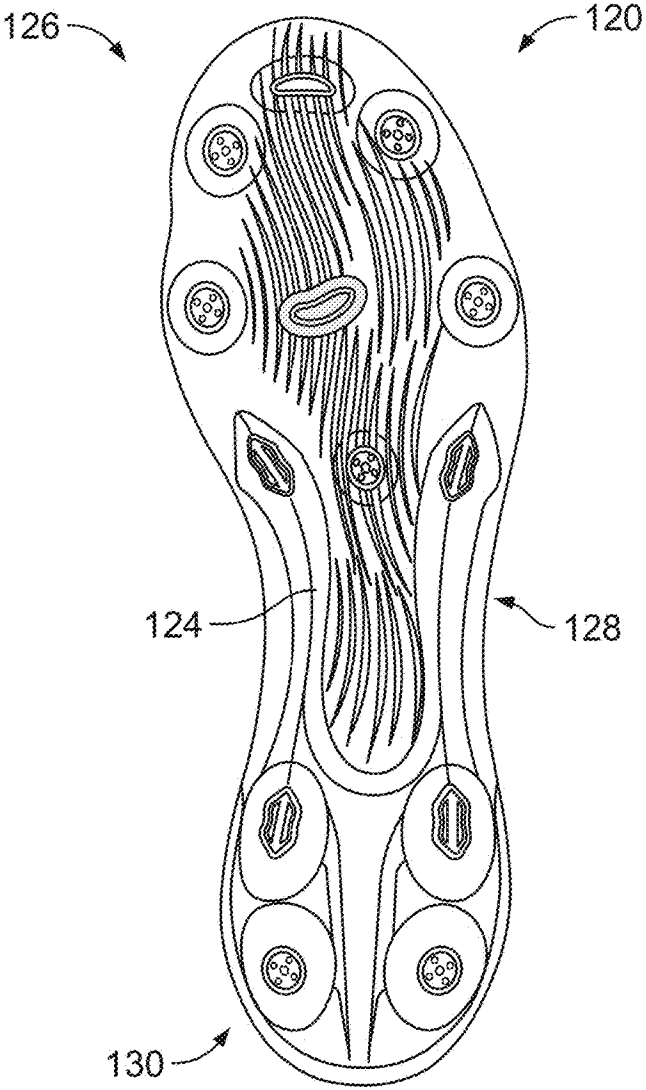
FIG. 5 is a bottom plan view of the article of footwear of FIG. 3.

Unless otherwise specified, and specifically referring to the bottom plan view of FIG. 5, the forefoot region 126, the midfoot region 128, the heel region 130, the medial side, and the lateral side are intended to define boundaries or areas of the article of footwear 120. To that end, the forefoot region 126, the midfoot region 128, the heel region 130, the medial side and the lateral side generally characterize sections of the article of footwear 120. Certain aspects of the disclosure may refer to portions or elements that are coextensive with one or more of the forefoot region 126, the midfoot region 128, the heel region 130, the medial side, and/or the lateral side. Further, both the upper 122 and the sole structure 124 may be characterized as having portions within the forefoot region 126, the midfoot region 128, the heel region 130, and on the medial side and the lateral side. Therefore, the upper 122 and the sole structure 124, and/or individual portions of the upper 122 and the sole structure 124, may include portions thereof that are disposed within the forefoot region 126, the midfoot region 128, the heel region 130, and on the medial side and the lateral side.

In general, the forefoot region 126 extends from a toe end to a widest portion of the article of footwear 120. The widest portion is defined or measured along a line that is perpendicular with respect to a longitudinal axis that extends from a distal portion of the toe end to a distal portion of a heel end, which is opposite the toe end. The midfoot region 128 extends from the widest portion to a thinnest portion of the article of footwear 120. The thinnest portion of the article of footwear 120 is defined as the thinnest portion of a waist of the article of footwear 120 measured across a line that is perpendicular with respect to the longitudinal axis. The heel region 130 extends from the thinnest portion to the heel end of the article of footwear 120.

The medial side begins at the heel end and bows outward along an inner side of the article of footwear 120 along the heel region 130 toward the midfoot region 128. The medial side reaches a widest heel portion at which point the medial side bows inward, toward the longitudinal axis. The medial side extends into the midfoot region 128, from the widest heel portion toward the thinnest portion. From the thinnest portion, the medial side bows outward, away from the longitudinal axis toward the widest portion at which point the medial side extends into the forefoot region 126 and toward the widest portion. Once at the widest portion, the medial side bows inward toward the toe end, where the medial side intersects the lateral side of the article of footwear 120.

The lateral side also begins at the heel end and bows outward along an outer side of the article of footwear 120 along the heel region 130 toward the midfoot region 128. The medial side reaches the widest heel portion at which point the lateral side bows inward, toward the longitudinal axis. The lateral side extends into the midfoot region 128, from the widest heel portion toward the thinnest portion. From the thinnest portion, the lateral side bows outward, away from the longitudinal axis toward the widest portion at which point the medial side extends into the forefoot region 126 and toward the widest portion. Once at the widest portion, the lateral side bows inward toward the toe end, where the lateral side intersects the medial side, as discussed above.

The sole structure 124 is connected or secured to the upper 122 and extends between a foot of a user and the ground when the article of footwear 120 is worn by the user. The sole structure 124 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user.

The upper 122 extends upwardly from the sole structure 124 and defines the interior cavity that receives and secures a foot of a user. The upper 122 may be defined by a foot region and an ankle region. In general, the foot region extends upwardly from the sole structure 124 and through the forefoot region 126, the midfoot region 128, and the heel region 130. The ankle region is primarily located in the heel region 130; however, in some embodiments, the ankle region may partially extend into the midfoot region 128.

In some embodiments, the article of footwear 120 may also have a lacing system including a lace, a plurality of apertures, and a plurality of bands or lacing straps. In other embodiments, an article of footwear, similar to the article of footwear 120 may be laceless. For example, properties of the upper 122 (e.g., elasticity) may secure the article of footwear 120 to a foot of a user without the use of lacing straps.

With continued reference to FIGS. 3-6, the upper 122 may generally extend along the lateral side and the medial side, and may extend across the forefoot region 126, the midfoot region 128, and the heel region 130 to house and enclose a foot of a user. The upper 122 also includes an interior surface and an exterior surface. The interior surface faces inward and generally defines the interior cavity, and the exterior surface of the upper 122 faces outward and generally defines an outer perimeter or boundary of the upper 122. The upper 122 also includes an opening that is at least partially located in the heel region 130 of the article of footwear 120, that provides access to the interior cavity and through which a foot may be inserted and removed.

Figure 7:
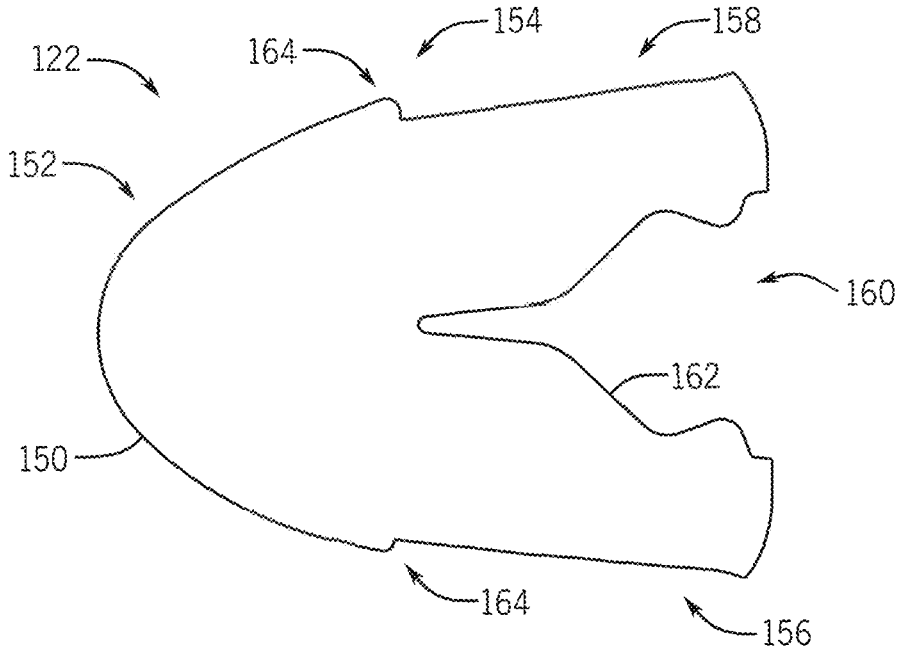
FIG. 7 is a plan view of a layer of an upper of the article of footwear of FIG. 3.
Figure 8:
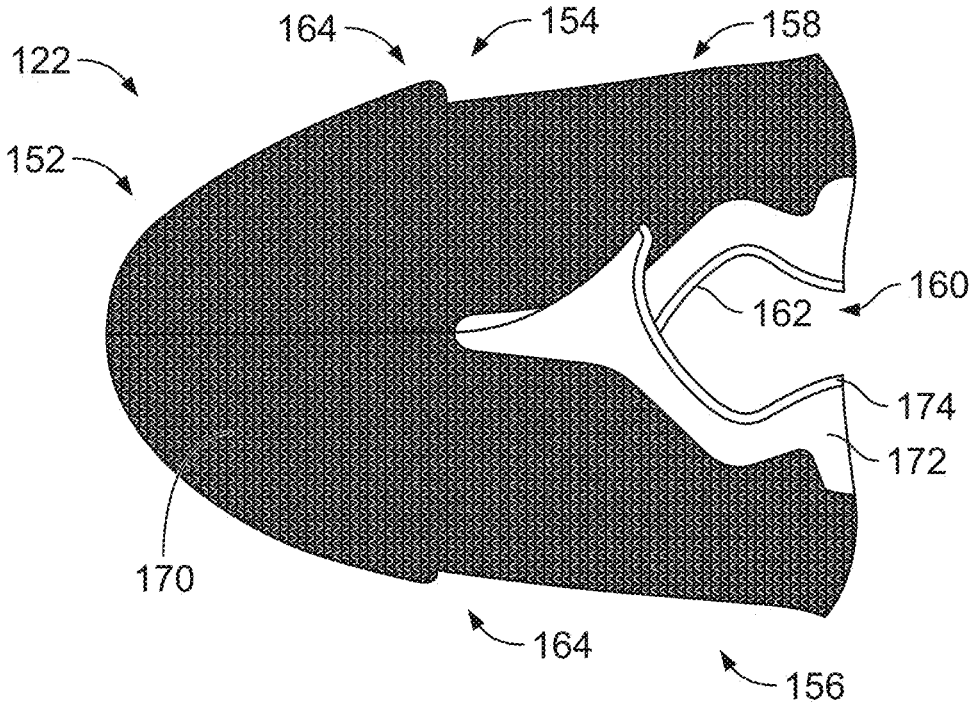
FIG. 8 is a plan view of the upper of FIG. 7 including a material layer.
Figure 9:
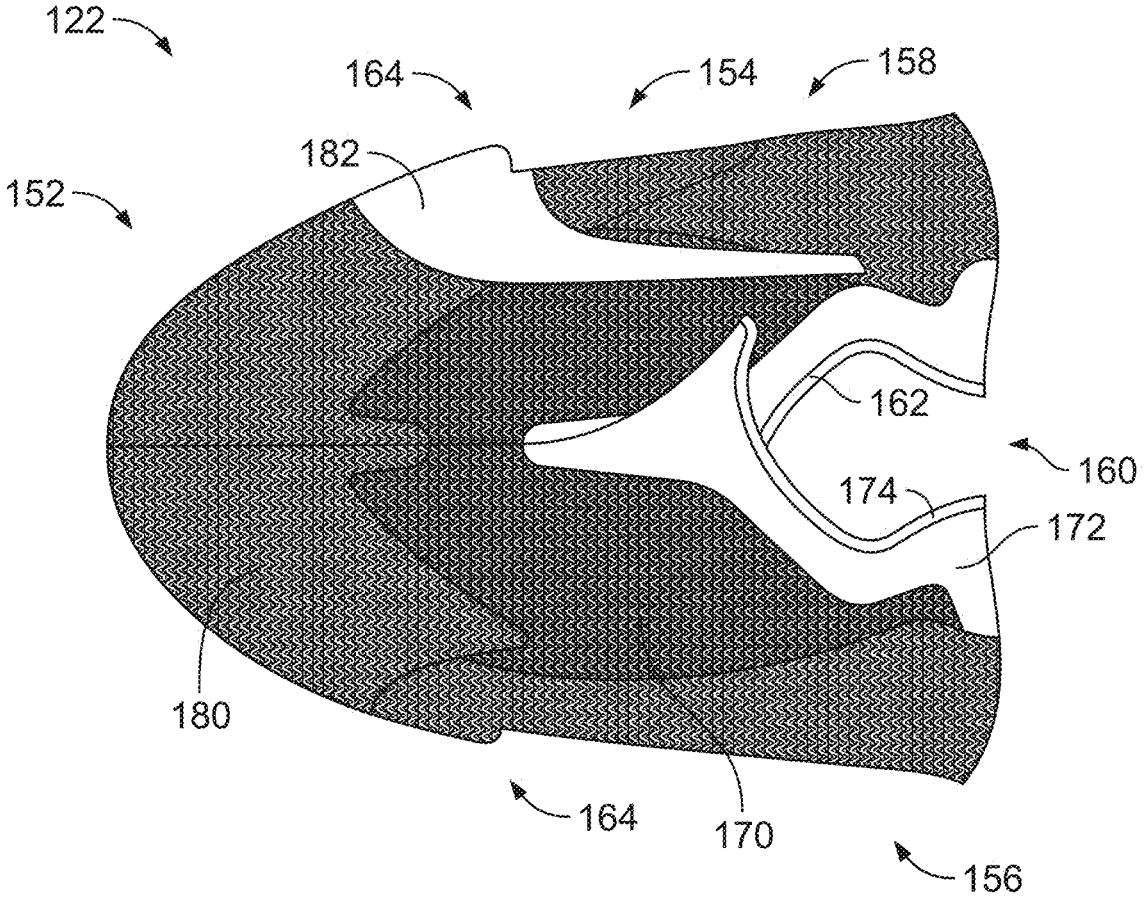
FIG. 9 is a plan view of the upper of FIG. 8 including a tint layer.

Referring now to FIGS. 7-9, the upper 122 can include one or more layers that can provide support, stretch-resistance, flexibility, air-permeability, or moisture-wicking properties. In particular, FIG. 7 illustrates a membrane layer 150 according to some embodiments of the disclosure. The membrane layer 150 can be configured as a one-way membrane, so that moisture can pass in only a single direction through the membrane layer 150. For example, the membrane layer 150 may be configured to transfer moisture from a foot from an inside to an outside of the article of footwear 120 while preventing moisture from entering the inside of the article of footwear from the outside so that the outside of the upper 122 is substantially waterproof.

The membrane layer 150 may have a geometric profile that is substantially similar to the profile of the upper 122 prior to the upper 122 being affixed to the sole structure 124. The membrane 150 includes a forefoot region 152, a midfoot region 154, a medial heel region 156, and a lateral heel region 158. When the upper 122 is affixed to the sole structure 124, the forefoot region 152 and the midfoot region 154 generally correspond to and are disposed proximate to the corresponding forefoot region 126 and midfoot region 128 of the article of footwear 120. Correspondingly, the medial heel region 156 and the lateral heel region 158 generally correspond to and are disposed proximate to the corresponding heel region 130 of the article of footwear 120.

The medial heel region 156 and the lateral heel region 158 define a tongue gap 160 therebetween. The tongue gap 160 is further defined by a topline 162 that is contoured and surrounds the tongue gap 160. The tongue gap 160 extends between the medial heel region 156 and the lateral heel region 158. The membrane layer 150 further includes medial and lateral contours 164 proximate to the midfoot region 154. In some embodiments, the contours 164 can correspond to contours of the sole structure 124.

FIG. 8 illustrates a material layer 170 and a tongue material 172 affixed to the membrane layer 150 according to some embodiments of the disclosure. In some embodiments, the material layer 170 can be secured to the membrane layer 150 via a stitching line. The stitching line can vary in thickness and material properties and may provide additional structural support to the upper 122. For example, the stitching line can be applied in areas of the upper 122 requiring particular support, such as to provide a support against pronation, for example. In the illustrated embodiment, the tongue material 172 is secured to the membrane layer 150 proximate to the tongue gap 160 via an adhesion strip 174, such as no-sew tape, for example. The adhesion strip 174 is secured along at least a portion of the topline 162.

FIG. 9 illustrates a skin 180 vacuumed to a portion of the material layer 170 according to some embodiments of the disclosure. In the illustrated embodiment, the skin 180 is a TPU skin that has a 30% tint. Some embodiments of the disclosure can include a skin that has tint that can range between 0% tint (e.g., clear) and 100% tint (e.g., opaque). The skin 180 can be affixed to the upper 122 along medial and lateral sides including at the forefoot region 152, the midfoot region 154, the medial heel region 156, and the lateral heel region 158. The upper 122 can also include a finish element 182 that is configured as a hologram finish. The finish element 182 can be secured to the skin 180.

Figure 10:
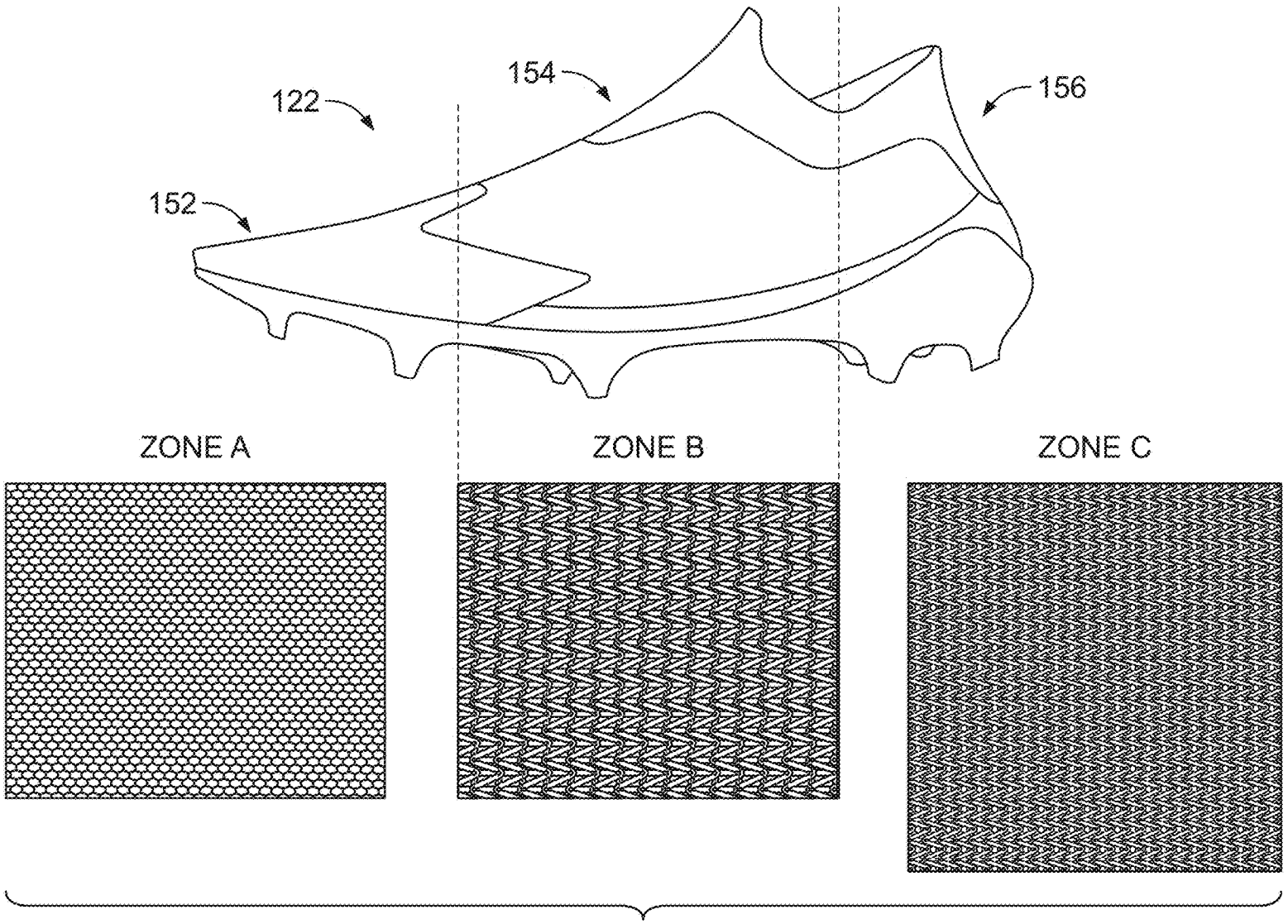
FIG. 10 is schematic left side elevational view of the article of footwear of FIG. 3 including knit zones.

Referring now to FIG. 10, the material layer 170 can include varying knit zones. In the illustrated embodiment, the material layer 170 includes Zone A, Zone B, and Zone C. Zone A is generally located in the forefoot region 152, Zone B is generally located in the midfoot region 154, and Zone C is generally located in the heel region 156, 158. As briefly discussed above, an article of footwear can have a variety of knitting constructions within a material layer. The varied knitting constructions can enhance stability and improve characteristics of the article of footwear at targeted zones, such as breathability and support, for example. Illustrated in FIG. 10, Zone A generally has a denser knit when compared with Zones B and C. Likewise, Zone B generally has a less dense knit when compared with Zones A and C.

Figure 11:
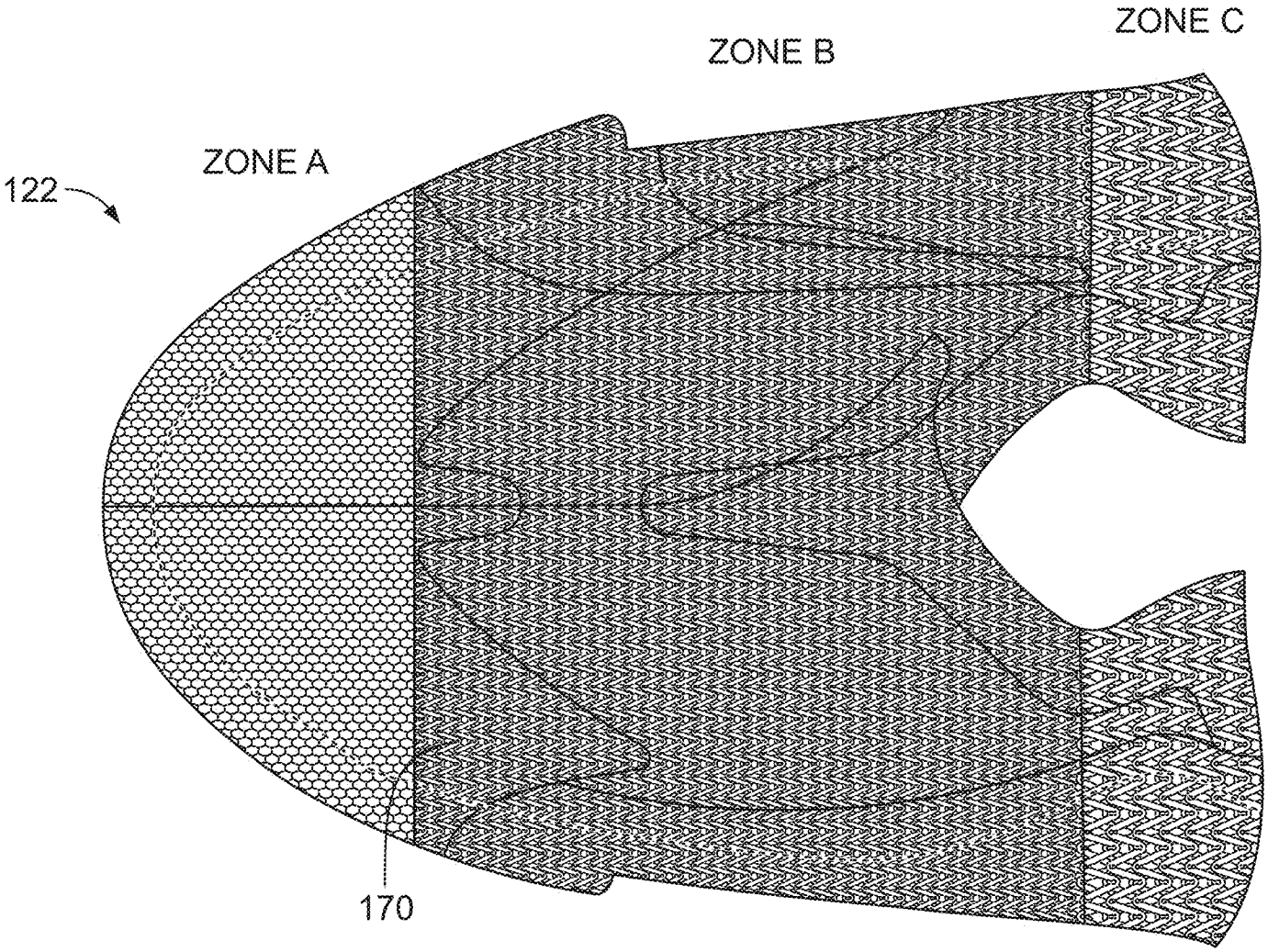
FIG. 11 is a plan view of the upper of FIG. 8 including the knit zones of FIG. 10.

FIG. 11 illustrates an example of the knit zones across the upper 122 and formed in the material layer 170. In some embodiments, the upper 122 can be formed from a single material so that Zone A and Zone C are integrally formed with Zone B. In some embodiments, the knit zones can extend across multiple regions of the article of footwear, such as the forefoot region, the midfoot region, and the heel region, for example.

In some embodiments, each zone can have varying material characteristics, such as, for example, breathability, permeability, flexibility, supportability, durability, rigidity, etc. In particular, depending on the application of the article of footwear (e.g., for use in a particular sport), it may be generally useful to decrease flexibility in a forefoot region of an upper and increase breathability in a midfoot region of an upper to promote toe stability and increased airflow near a central region of a foot. In general, breathability is the ability of a fabric, material, weave, or knit to allow moisture vapor to be transmitted through the material. For example, a first material or first material zone may be more breathable than a second material or second material zone if more moisture is allowed to pass through the first material or first material zone.

Figure 12:
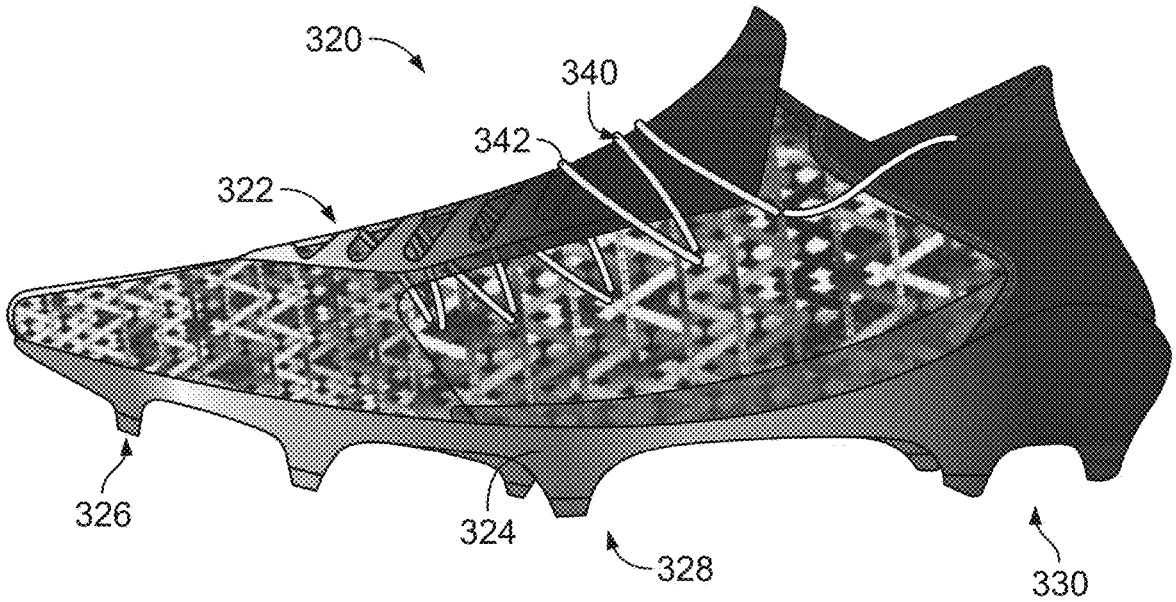
FIG. 12 is a left side elevational view of an article of footwear according to some embodiments of the present disclosure.
Figure 13:
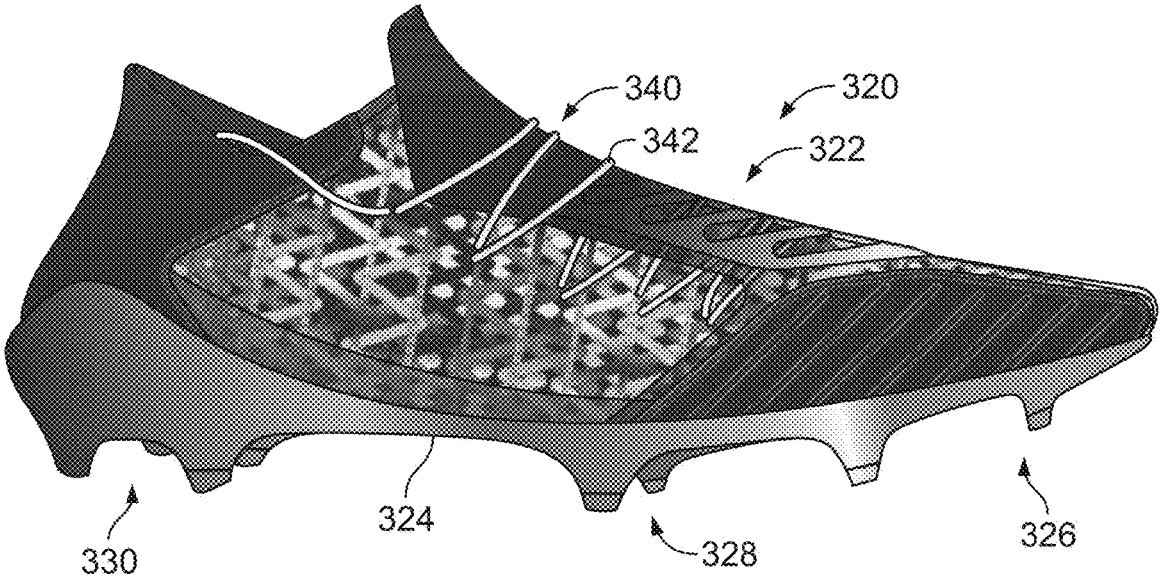
FIG. 13 is a right side elevational view of the article of footwear of FIG. 12.
Figure 14:
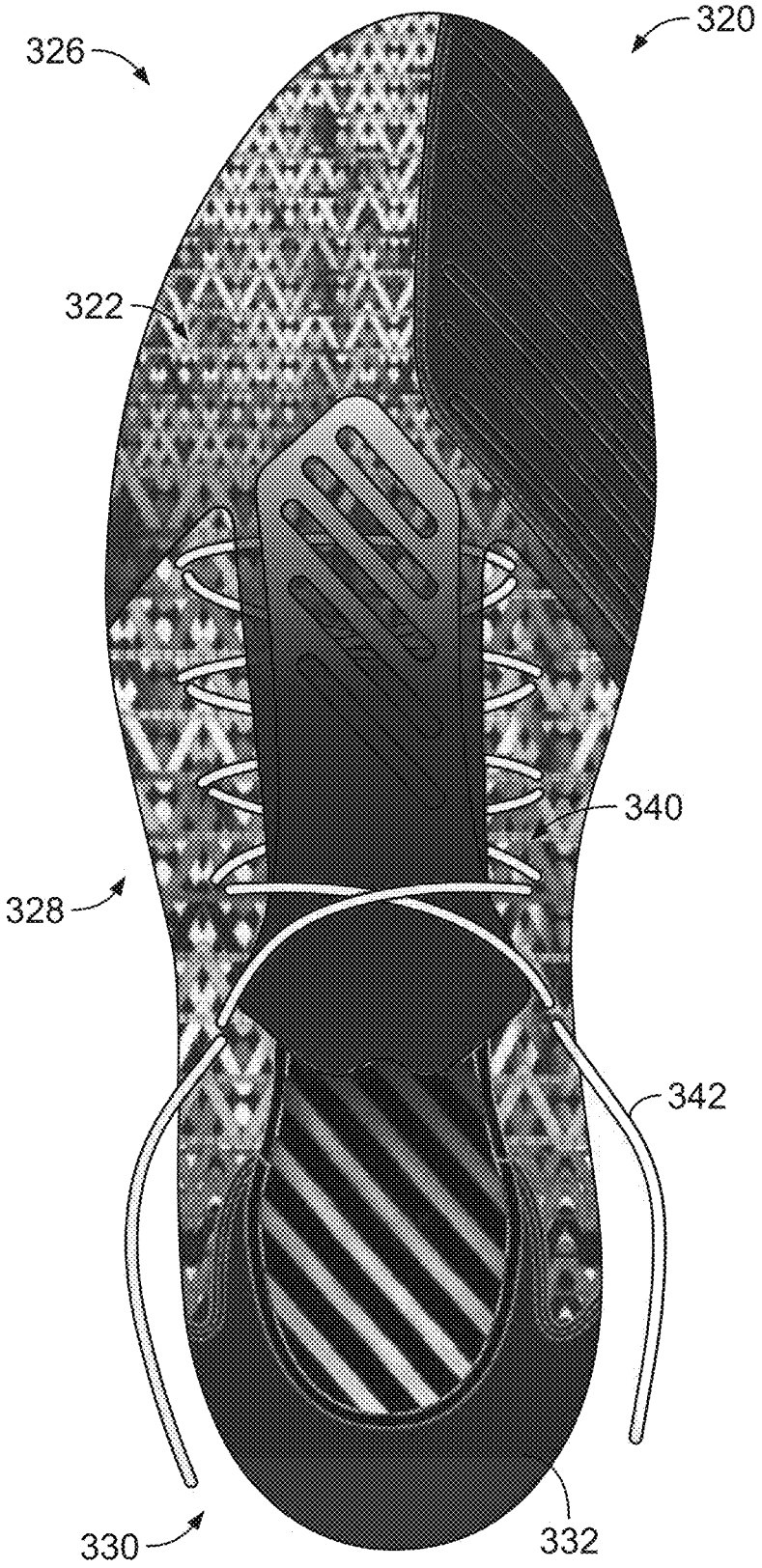
FIG. 14 is a top perspective view of the article of footwear of FIG. 12.

FIGS. 12-14 depict another exemplary embodiment of an article of footwear 320. Similar to the article of footwear 120, the article of footwear 320 includes an upper 322 and a sole structure 324. The upper 322 is attached to the sole structure 324 and together define an interior cavity into which a foot may be inserted. The article of footwear 320 defines a forefoot region 326, a midfoot region 328, and a heel region 330.

In some embodiments, the upper 322 of the article of footwear 320 is formed from a knitted structure or knitted components. In various embodiments, a knitted component may incorporate various types of yarn or lacing that may provide different properties to an upper. For example, one area of the upper 322 may be formed from a first type of yarn that imparts a first set of properties, and another area of the upper 322 may be formed from a second type of yarn that imparts a second set of properties. Using this configuration, properties of the upper 322 may vary throughout the upper 322 by selecting specific yarns for different areas of the upper 322. The materials forming the yarn and other aspects of the yarn may be selected to impart a variety of properties to particular areas of the upper 322.

In some embodiments, the upper 322 may also include additional structural elements. For example, in some embodiments, a heel element 332 may be provided on the heel region 330 to provide added support to a heel of a user. In some instances, other elements (e.g., plastic material, logos, trademarks, etc.) may also be applied and fixed to an exterior surface using glue or a thermoforming process. In some embodiments, the properties associated with the upper 322, e.g., a stitch type, a yarn type, or characteristics associated with different stitch types or yarn types, such as elasticity, aesthetic appearance, thickness, air permeability, or scuff-resistance, may be varied.

The article of footwear 320 includes a medial side (see FIG. 12) and a lateral side (see FIG. 13). In particular, the lateral side corresponds to an outside portion of the article of footwear 320 and the medial side corresponds to an inside portion of the article of footwear 320. As such, left and right articles of footwear have opposing lateral and medial sides, such that the medial sides are closest to one another when a user is wearing the articles of footwear 320, while the lateral sides are defined as the sides that are farthest from one another while being worn. As will be discussed in greater detail below, the medial side and the lateral side adjoin one another at opposing, distal ends of the article of footwear 320.

In general, the forefoot region 326 extends from a toe end to a widest portion of the article of footwear 320. The widest portion is defined or measured along a line that is perpendicular with respect to a longitudinal axis that extends from a distal portion of the toe end to a distal portion of a heel end, which is opposite the toe end. The midfoot region 328 extends from the widest portion to a thinnest portion of the article of footwear 320. The thinnest portion of the article of footwear 320 is defined as the thinnest portion of a waist of the article of footwear 320 measured across a line that is perpendicular with respect to the longitudinal axis. The heel region 330 extends from the thinnest portion to the heel end of the article of footwear 320.

The medial side begins at the heel end and bows outward along an inner side of the article of footwear 320 along the heel region 330 toward the midfoot region 328. The medial side reaches a widest heel portion at which point the medial side bows inward, toward the longitudinal axis. The medial side extends into the midfoot region 328, from the widest heel portion toward the thinnest portion. From the thinnest portion, the medial side bows outward, away from the longitudinal axis toward the widest portion at which point the medial side extends into the forefoot region 326 and toward the widest portion. Once at the widest portion, the medial side bows inward toward the toe end, where the medial side intersects the lateral side of the article of footwear 320.

The lateral side also begins at the heel end and bows outward along an outer side of the article of footwear 320 along the heel region 330 toward the midfoot region 328. The medial side reaches the widest heel portion at which point the lateral side bows inward, toward the longitudinal axis. The lateral side extends into the midfoot region 328, from the widest heel portion toward the thinnest portion. From the thinnest portion, the lateral side bows outward, away from the longitudinal axis toward the widest portion at which point the medial side extends into the forefoot region 326 and toward the widest portion. Once at the widest portion, the lateral side bows inward toward the toe end, where the lateral side intersects the medial side, as discussed above.

The sole structure 324 is connected or secured to the upper 322 and extends between a foot of a user and the ground when the article of footwear 320 is worn by the user. The sole structure 324 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user.

The upper 322 extends upwardly from the sole structure 324 and defines the interior cavity that receives and secures a foot of a user. The upper 322 may be defined by a foot region and an ankle region. In general, the foot region extends upwardly from the sole structure 324 and through the forefoot region 326, the midfoot region 328, and the heel region 330. The ankle region is primarily located in the heel region 330; however, in some embodiments, the ankle region may partially extend into the midfoot region 328.

In some embodiments, the article of footwear 320 may also have a lacing system 340 including a lace 342, and a plurality of bands or lacing straps. In other embodiments, an article of footwear, similar to the article of footwear 320 may be laceless. For example, properties of the upper 322 (e.g., elasticity) may secure the article of footwear 320 to a foot of a user without the use of lacing straps.

With continued reference to FIGS. 12-14, the upper 322 may generally extend along the lateral side and the medial side, and may extend across the forefoot region 326, the midfoot region 328, and the heel region 330 to house and enclose a foot of a user. The upper 322 also includes an interior surface and an exterior surface. The interior surface faces inward and generally defines the interior cavity, and the exterior surface of the upper 322 faces outward and generally defines an outer perimeter or boundary of the upper 322. The upper 322 also includes an opening that is at least partially located in the heel region 330 of the article of footwear 120, that provides access to the interior cavity and through which a foot may be inserted and removed.

Figure 15:
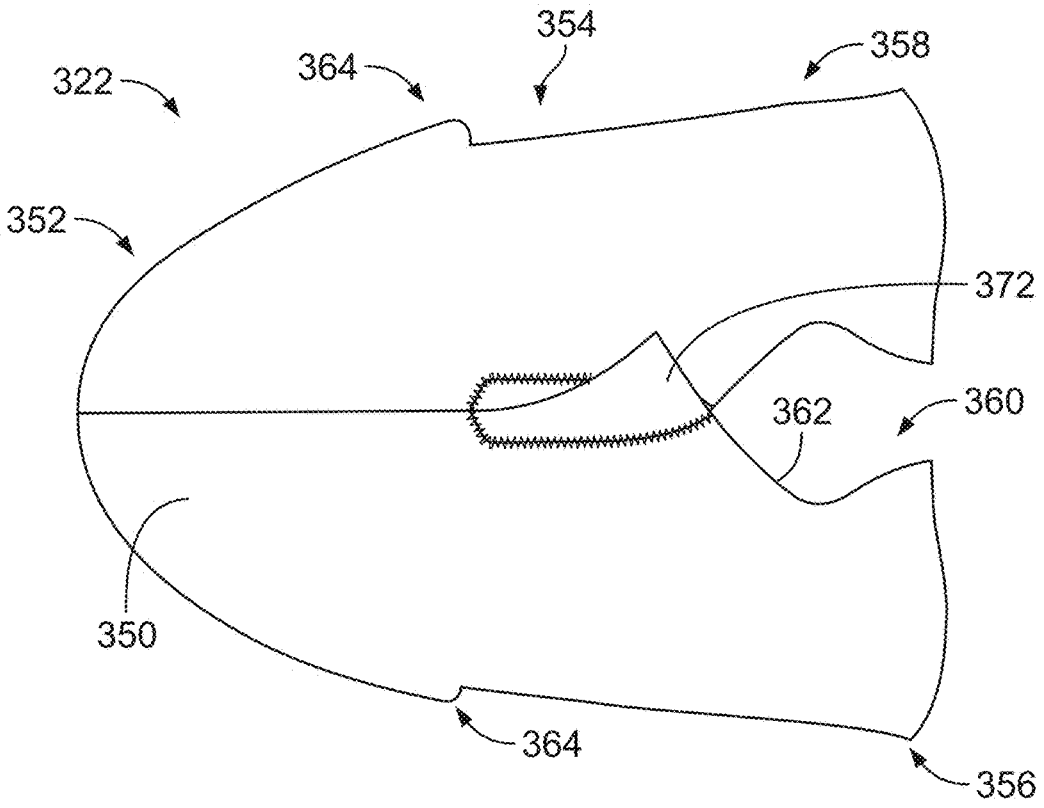
FIG. 15 is a plan view of a layer of an upper of the article of footwear of FIG. 12.

Referring now to FIGS. 15-21, the upper 322 can include one or more layers that can provide support, stretch-resistance, flexibility, air-permeability, or moisture-wicking properties. In particular, FIG. 15 illustrates a membrane layer 350 according to some embodiments of the disclosure. The membrane layer 350 may have a geometric profile that is substantially similar to the profile of the upper 322 prior to the upper 322 being affixed to the sole structure 324. The membrane layer 350 includes a forefoot region 352, a midfoot region 354, a medial heel region 356 and a lateral heel region 358. When the upper 322 is affixed to the sole structure 324, the forefoot region 352 and the midfoot region 354 generally correspond to and are disposed proximate to the corresponding forefoot region 326 and midfoot region 328 of the article of footwear 320. Correspondingly, the medial heel region 356 and the lateral heel region 358 generally correspond to and are disposed proximate to the corresponding heel region 332 of the article of footwear 320.

The medial heel region 356 and the lateral heel region 358 define a tongue gap 360 therebetween. The tongue gap 360 is further defined by a topline 362 that is contoured and surrounds the tongue gap 360. The tongue gap 360 extends between the medial heel region 356 and the lateral heel region 358. The membrane layer 350 further includes medial and lateral contours 364 proximate to the midfoot region 354. In some embodiments, the contours 364 can correspond to contours of the sole structure 324.

Figure 16:
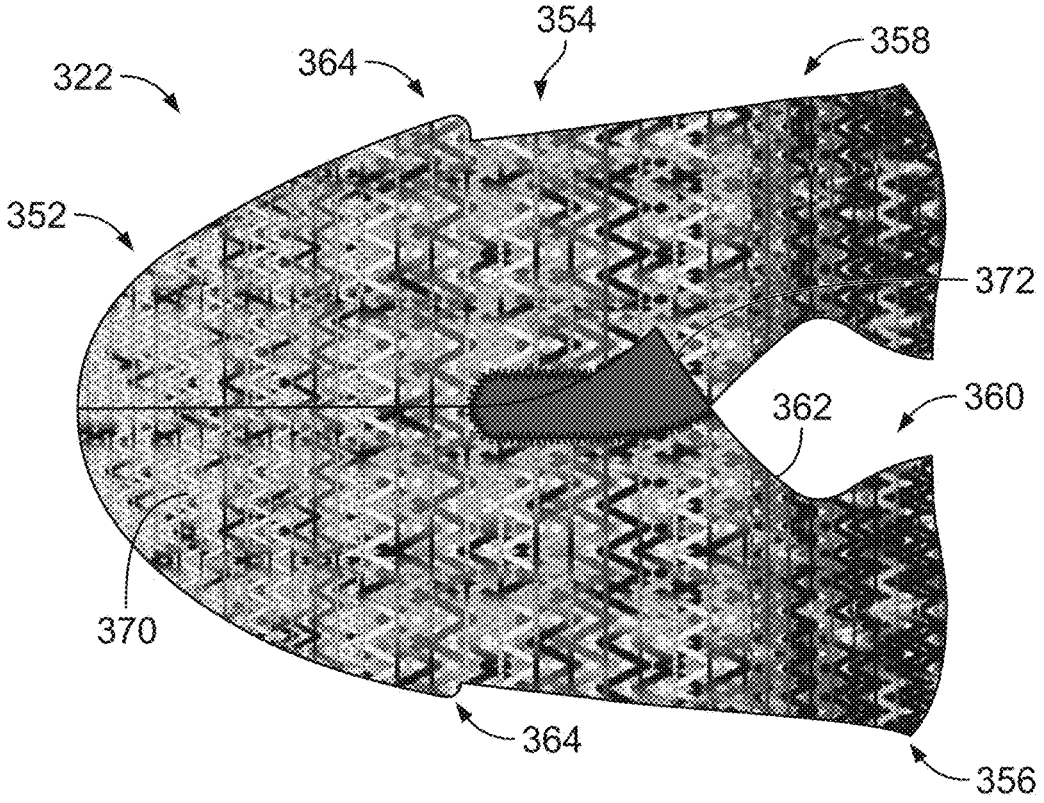
FIG. 16 is a plan view of the upper of FIG. 15 including a material layer.
Figure 17:
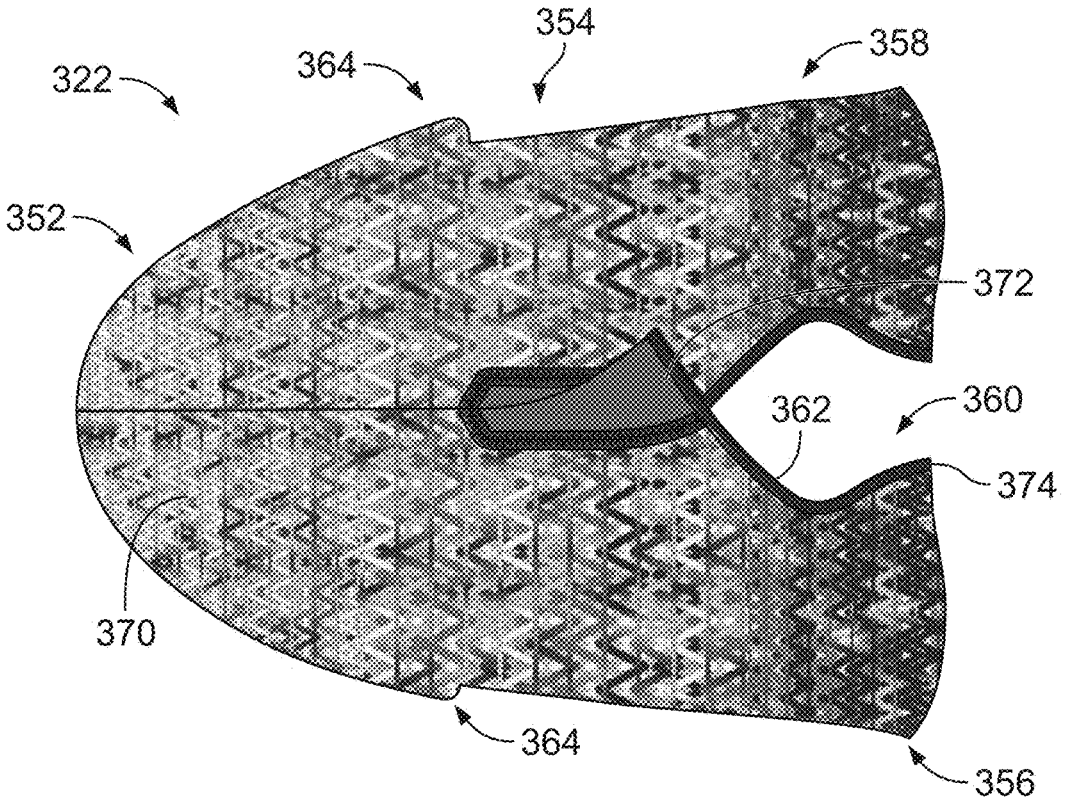
FIG. 17 is a plan view of the upper of FIG. 16 including a tape layer.

FIG. 16 illustrates a material layer 370 and a tongue material 372 that is stretchable and affixed to the membrane layer 350 via a zig zag stitch according to some embodiments of the disclosure. FIG. 17 illustrates an adhesion strip 374 that can help secure the material layer 370 to the membrane layer 350. The adhesion strip 374 is secured along at least a portion of the topline 362 proximate to the tongue gap 360.

Referring back to FIGS. 12-14, the material layer 370 is configured to receive the lace 342 of the lacing system 340. For example, the lace 342 can be threaded through the material layer 370 to secure the lacing system 340 to the upper 322 so that the lace 342 passes through a plurality of stiches in the material layer 370. The lacing system 340 is configured to be secured to the upper 322 so that when the lace 342 is pulled in a tensioning direction, at least a portion of the upper 322 is constricted around a foot within the interior cavity.

Figure 18:
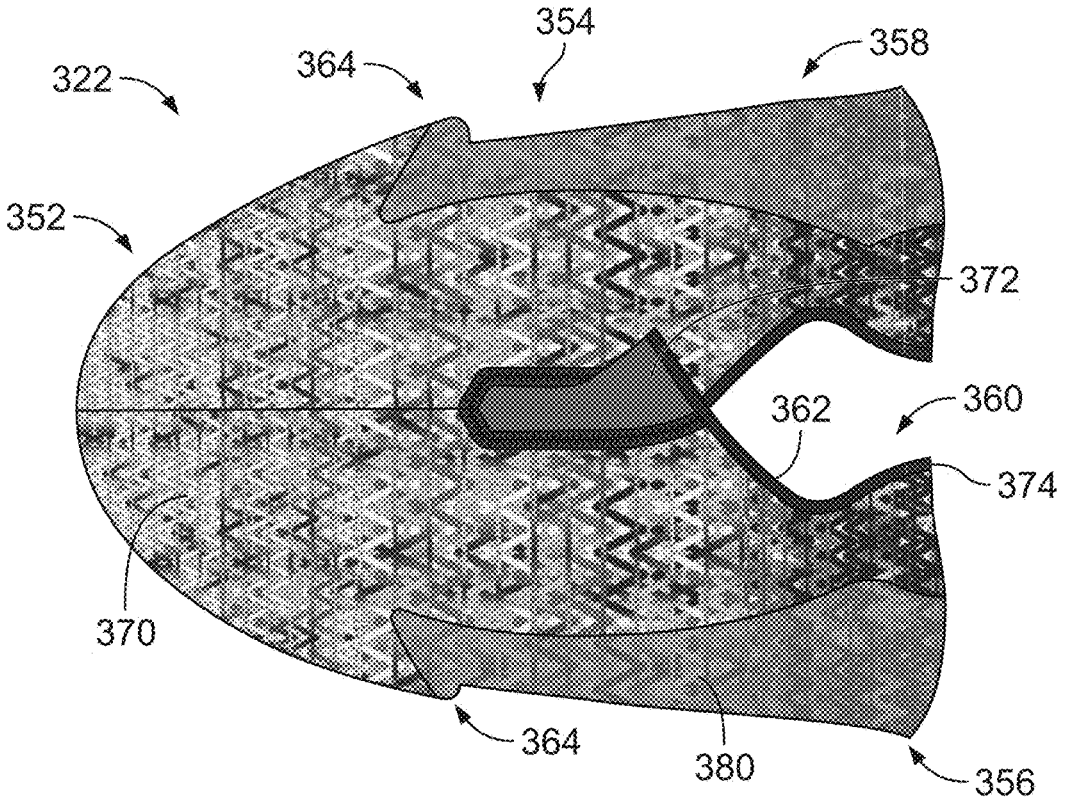
FIG. 18 is a plan view of the upper of FIG. 17 including a ting layer.

In some embodiments, reinforcements, such as additional stitching or stronger yarn, for example, may be added around the portions of the material layer 370 that the lace 342 extends through. The reinforcements may be used to limit the stretching capabilities of the portions of the material layer 370 that the lace 342 extends through. Further, the lace 342 may be configured to be selectively secured to the upper 322 at a variety of locations in the material layer 370 so that the lacing system 340 is customizable. For example, the lacing system 340 may be removed from the article of footwear 120 and re-threaded to provide a customizable style or tensioning effect on the upper 322. FIG. 18 illustrates a skin 380 vacuumed to a portion of the material layer 370 according to some embodiments of the disclosure. In the illustrated embodiment, the skin 380 is a TPU film that has a 10% tint. Some embodiments of the disclosure can include a film that has tint that can range between 0% tint (e.g., clear) and 100% tint (e.g., opaque). The skin 380 is affixed to the upper 322 along medial and lateral sides including at the midfoot region 354, the medial heel region 356, and the lateral heel region 358.

Figure 19:
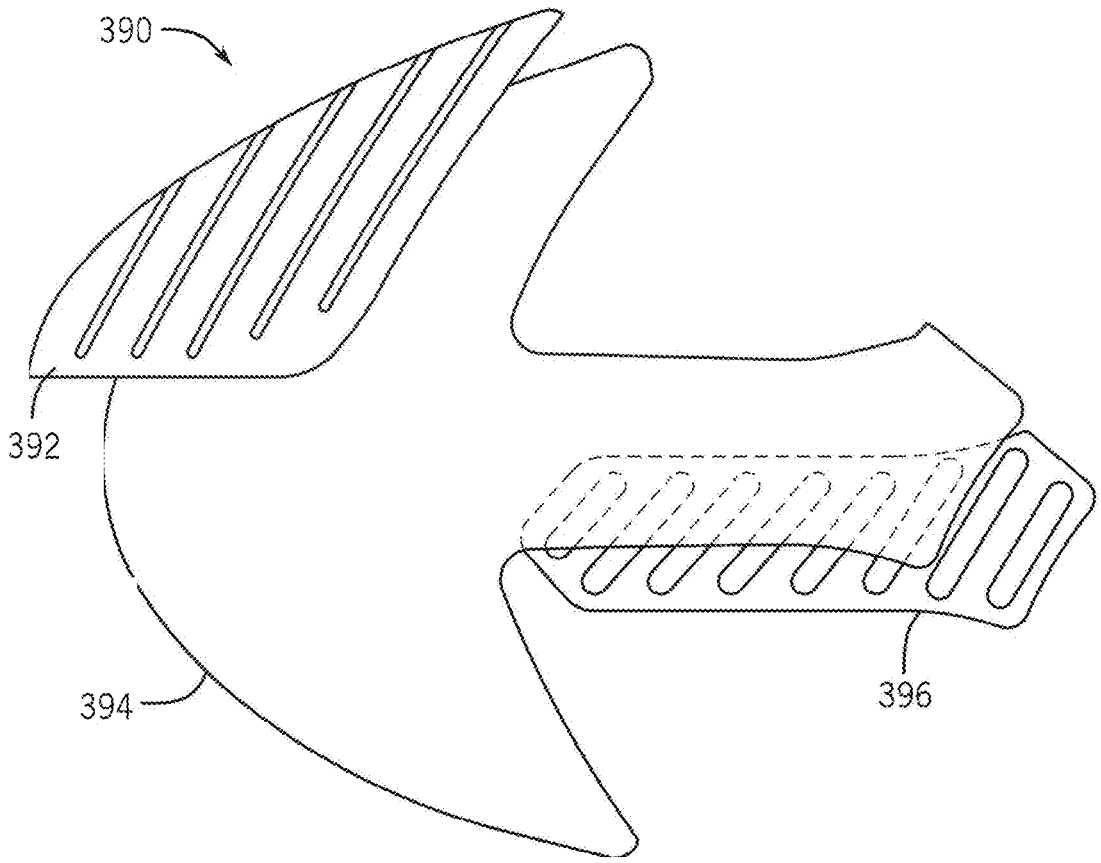
FIG. 19 is an exploded view of a vamp region of the article of footwear of FIG. 12.

Referring now to FIG. 19, the article of footwear 320 can also include a vamp assembly 390. The vamp assembly 390 includes a toe portion 392, a vamp body 394, and a tongue portion 396. In the illustrated embodiment, the toe portion 392 is formed from leather and is positioned near the medial forefoot region 326 of the article of footwear 320 (see, for example, FIG. 14). The leather toe portion 392 can be stitched to the vamp body 394. The vamp body 394 extends from the forefoot region 326 toward the midfoot region 328 of the article of footwear 320 and is secured to the upper 322. The vamp body 394 is configured to receive a marking, such as a logo, for example. In some embodiments, the marking may be screen printed to the vamp body 394.

The tongue portion 396 of the vamp assembly 390 can be positioned between the material layer 370 and the vamp body 394. In some embodiments, the tongue portion 396 may be between approximately 1 millimeter and 5 millimeters thick. The tongue portion 396 can be formed from a polymer, such as an ethylene-vinyl acetate (EVA) foam padding, for example. In the illustrated embodiment, the tongue portion 396 includes a plurality of angled cutouts; however, other configurations are possible. For example, a tongue portion 396 can include any number of cutouts, slots, recesses, contours, etc. In other embodiments, a vamp assembly can include a solid tongue portion. In general, the tongue portion 396 is loosely fitted to the upper 322 so that lace may be run underneath the vamp assembly 390.

Figure 20:
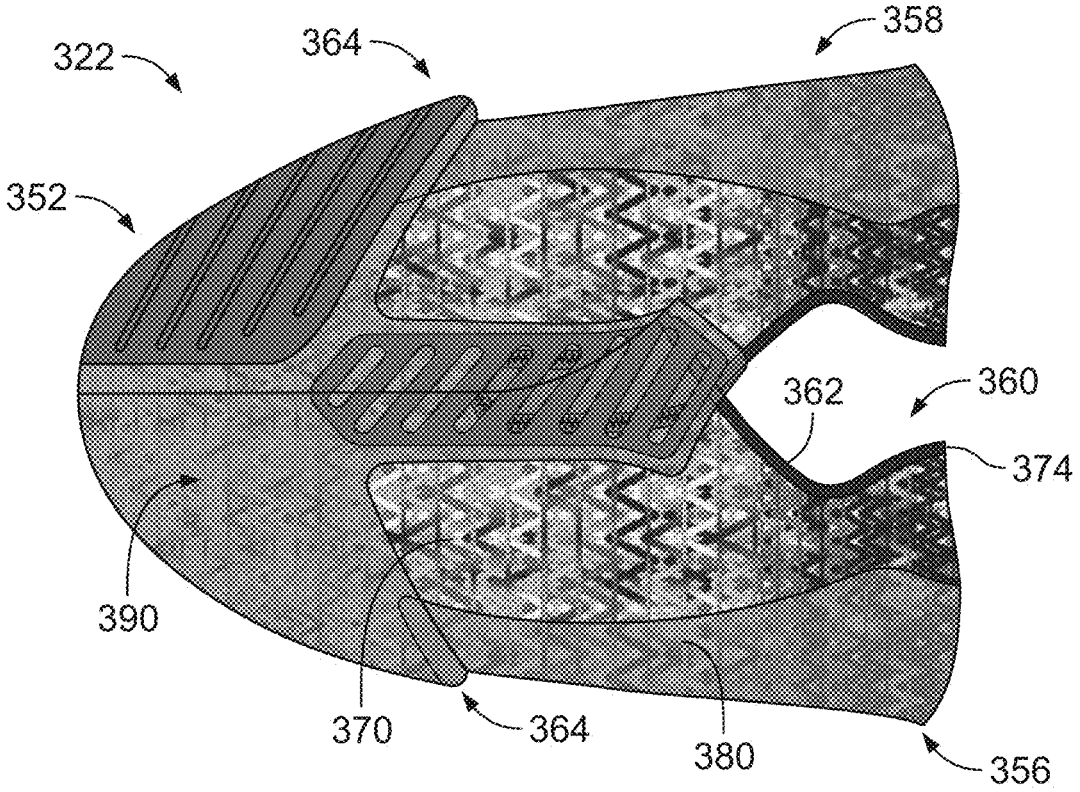
FIG. 20 is a plan view of the upper of FIG. 18 including the vamp region of FIG. 19.

FIG. 20 illustrates the vamp assembly 390 secured to the upper 322. A portion of the vamp body 394 is positioned proximate to the skin 380. Additionally, a portion of the vamp assembly 390, including the tongue portion 396, is positioned proximate to the tongue gap 360. In other embodiments, a vamp assembly can include one or more of a vamp body, a toe portion, and a tongue portion. In other embodiments, a toe portion, similar to the toe portion 392 can be made from other materials, such as a polymer, for example.

Figure 21:
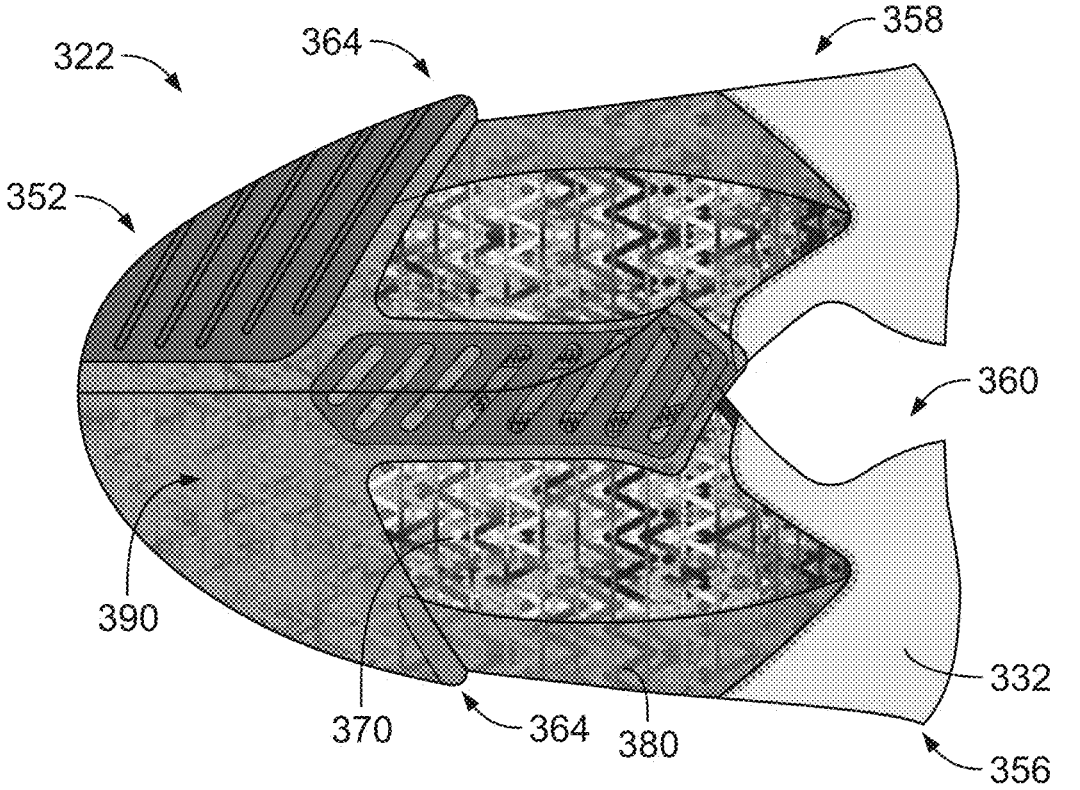
FIG. 21 is a plan view of the upper of FIG. 20 including a heel cap.

FIG. 21 illustrates the heel element 332 secured to the upper 322 at the medial heel region 356 and the lateral heel region 358. The heel element 332 is configured as a heel cap and is formed from a single piece of cow leather; however, other materials are possible. For example, in some embodiments, a heel cap can be formed from a variety of materials including natural materials and synthetic materials. The heel element 332 can be secured to the upper 322 via stitching. In the illustrated embodiments, the heel element 332 is secured proximate to the tongue gap 360.

Figure 22:
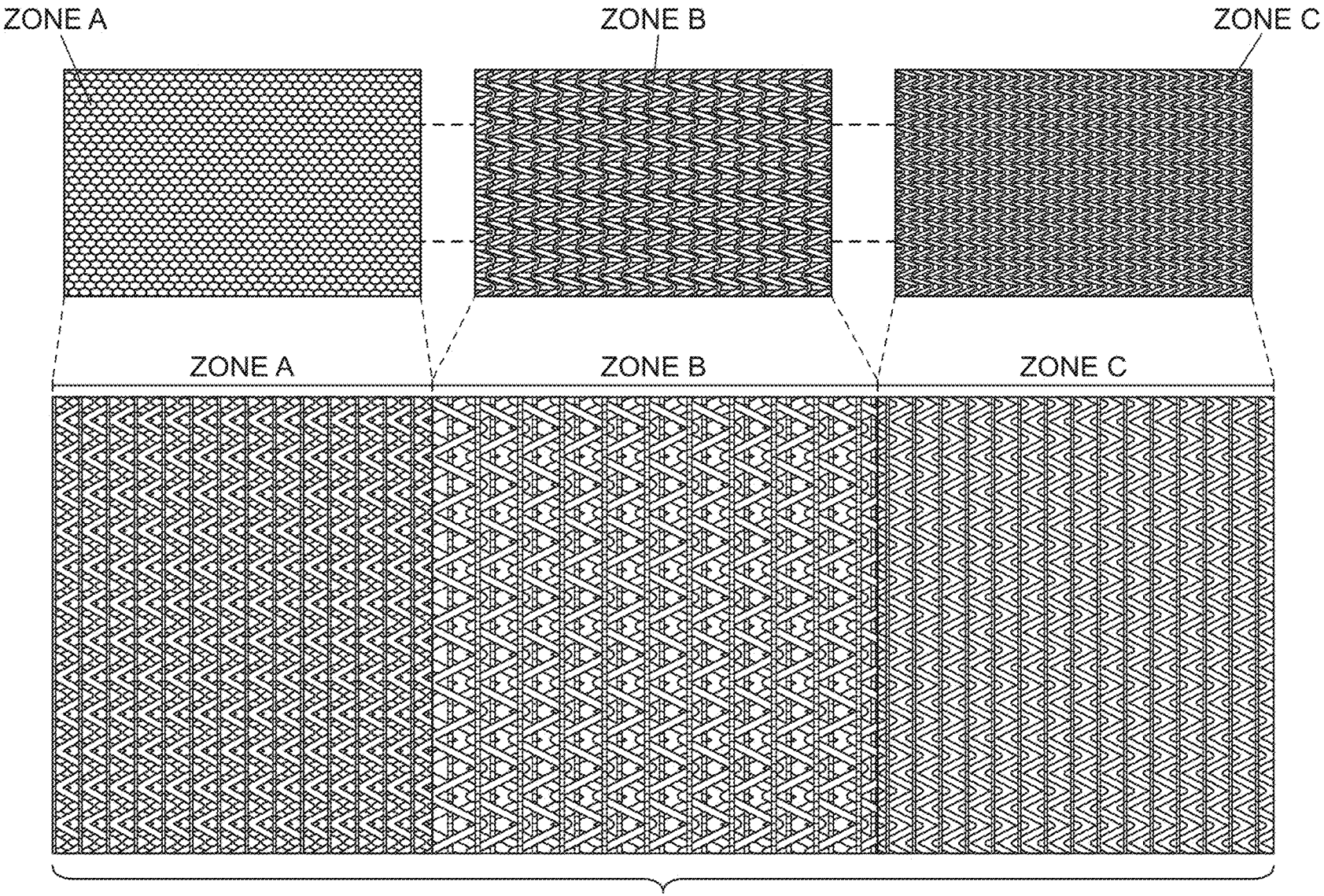
FIG. 22 depicts knit zones of the article of footwear of FIG. 12.

Referring now to FIG. 22, the material layer 370 can include varying knit zones. In the illustrated embodiment, the material layer 370 includes Zone A, Zone B, and Zone C. As briefly discussed above, an article of footwear can have a variety of knitting constructions within a material layer. The varied knitting constructions can enhance stability and improve characteristics of the article of footwear at targeted zones, such as breathability, for example. Illustrated in FIG. 10, Zone A generally has a denser knit when compared with Zones B and C. Likewise, Zone B generally has a less dense knit when compared with Zones A and C. As a result, each of Zone A can define a first elasticity, Zone B can define a second elasticity, and Zone C can define a third elasticity. In some embodiments, each of the first elasticity, the second elasticity, and the third elasticity can be different.

Figure 23:
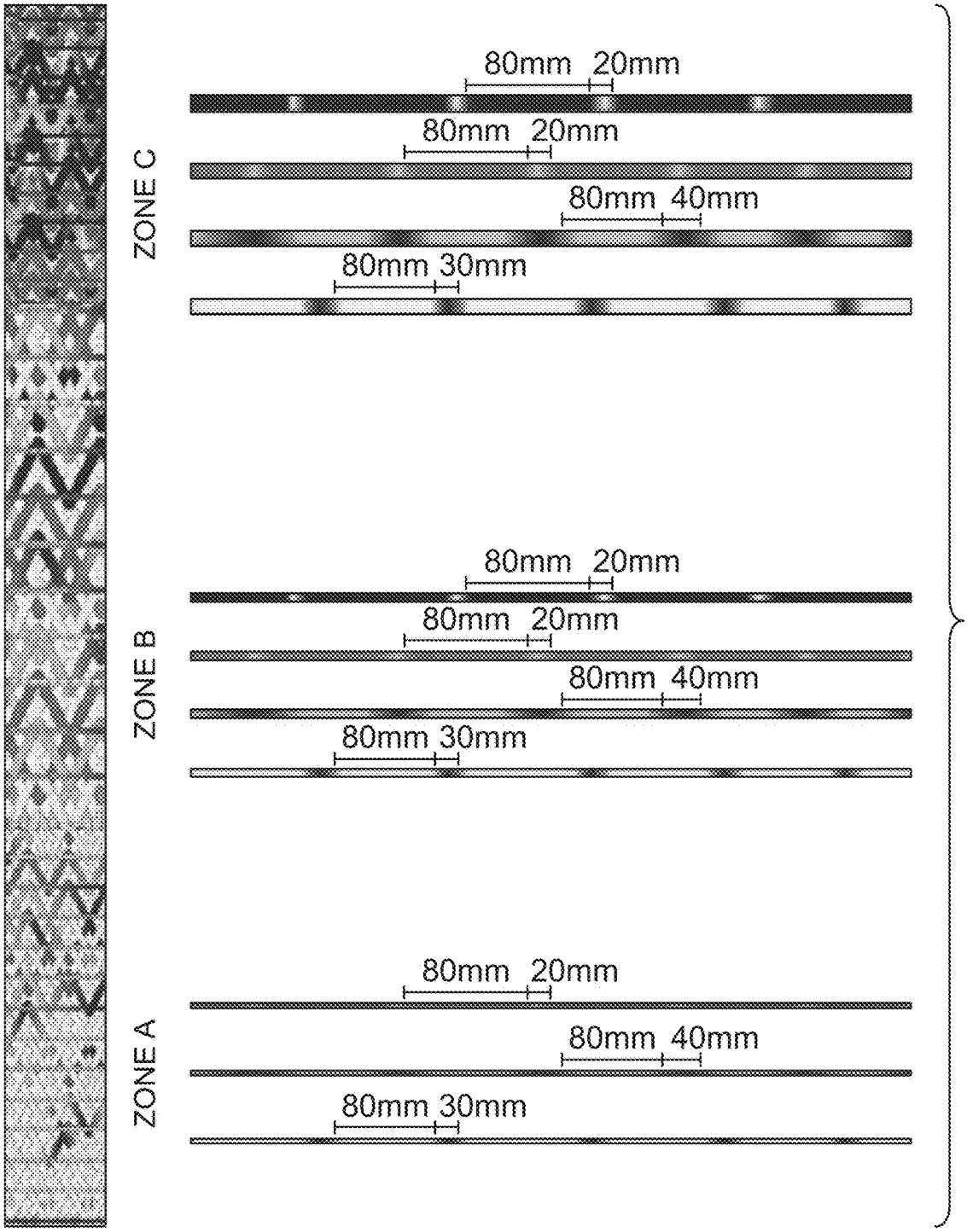
FIG. 23 is a schematic illustration of dye spacing for the knit zones of FIG. 22.
Figure 24:
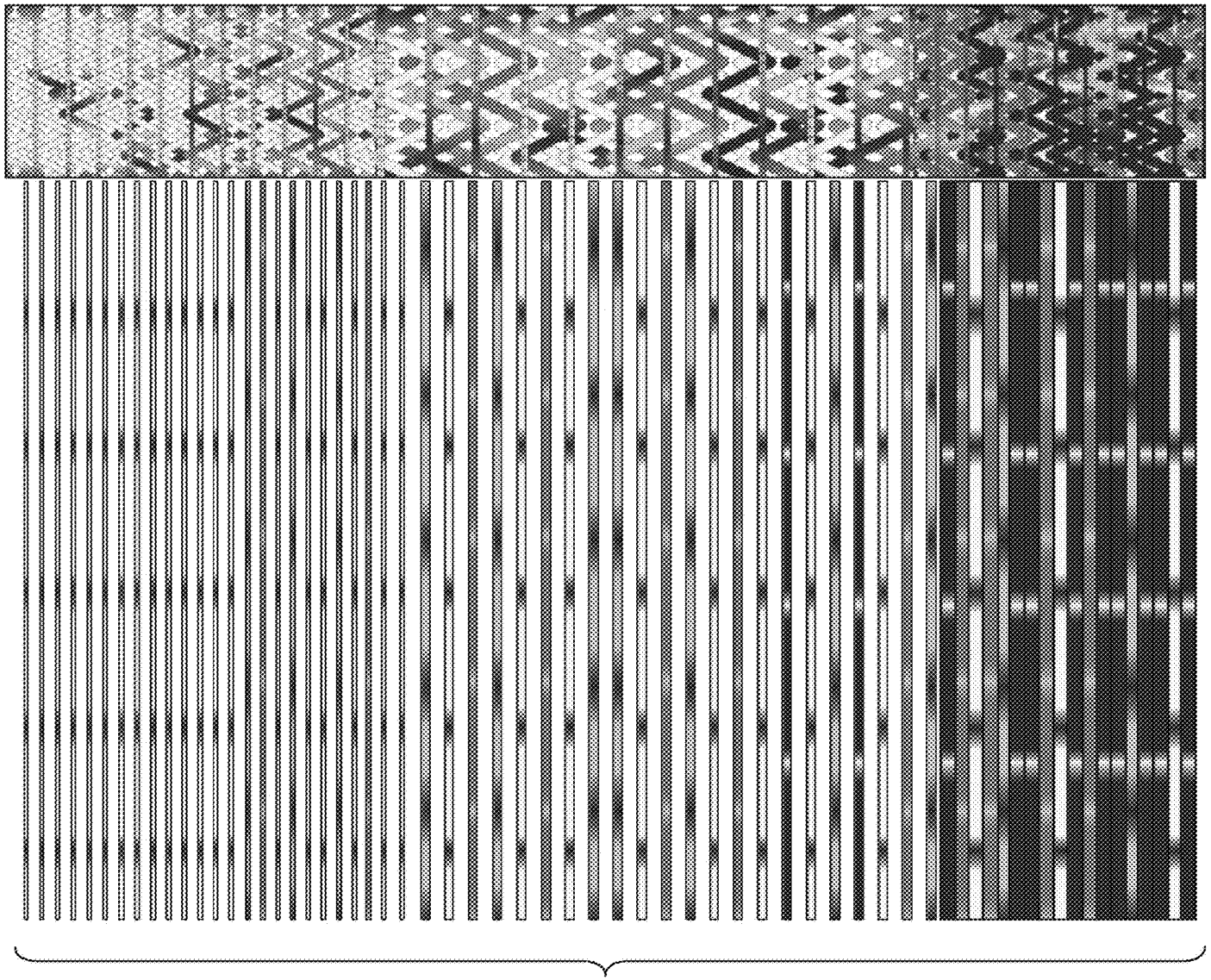
FIG. 24 is a schematic illustration of a thread gradient of the article of footwear of FIG. 12.

FIGS. 23 and 24 illustrate thread diameter, dye spacing, and thread gradient of the material layer 370 of the particle of footwear 320 according to embodiments of the disclosure. As illustrated in FIG. 23, the strands of thread in Zone A can define a first diameter, the strands of threads in Zone B can define a second diameter, and the strands of thread in Zone C can define a third diameter. In the illustrated embodiment, each of the first diameter, the second diameter, and the third diameter are different. In particular, the first diameter is smaller than the second diameter which is smaller than the third diameter. The thickness of the individual threads used in a particular zone of the upper 322 can be increased or decreased to provide a variety of patterns and material characteristics.

In some embodiments, the diameter of the threads in each of Zone A, Zone B, and Zone C of FIG. 23 may be between approximately 0.01 millimeters and approximately 50 millimeters. In particular, in some embodiments, the threads in Zone A may have a diameter between approximately 0.01 millimeters and approximately 8 millimeters, or between approximately 1 millimeter and 5 millimeters. Zone B may include a thread with a diameter between approximately 1 millimeter and approximately 15 millimeters, or between approximately 6 millimeters and approximately 10 millimeters. Zone C include thread having a diameter between approximately 1 millimeter and approximately 20 millimeters, or between approximately 8 millimeters and approximately 15 millimeters.

Further, the dye color and spacing along individual threads used in the knit that form the material layer 370 can provide a desired color gradient and pattern across the upper 322 of the article of footwear 320. In particular, in some embodiments, threads within Zone A can include a first color, threads within Zone B can include a second color, and threads within Zone C can include a third color. Each of the first color, the second color, and the third color can be distinct and/or different colors.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear defining a forefoot region, a midfoot region, a heel region, a lateral side, and a medial side, the article of footwear comprising:

an upper with an outer surface;

a heel element secured to the upper proximate to the heel region; and a sole structure, wherein the upper includes a knit fabric forming a first knit zone having a first elasticity, a second knit zone having a second elasticity, and a third knit zone having a third elasticity, wherein each of the first elasticity, the second elasticity, and the third elasticity are different, wherein the first knit zone and the second knit zone are defined by a webbing that forms a warp knit, the warp knit including a plurality of peaks and troughs, and wherein the plurality of peaks and troughs of a single line of webbing are closer together in the second knit zone than in the first knit zone.

2. The article of footwear of claim 1, wherein the first knit zone, the second knit zone, and the third knit zone are integrally formed.

3. The article of footwear of claim 1, wherein the first knit zone is disposed within the forefoot region, the second knit zone is disposed within the midfoot region, and the third knit zone is disposed within the heel region.

4. The article of footwear of claim 1, wherein the second elasticity is greater than the third elasticity.

5. The article of footwear of claim 1, wherein a breathability of the first knit zone is greater than a breathability of the second knit zone.

6. The article of footwear of claim 1 further comprising a membrane layer configured as a one-way membrane so that moisture can be transferred only from an inside of the article of footwear to an outside of the article of footwear while preventing moisture from entering an inside of the article of footwear from an outside of the article of footwear.

7. The article of footwear of claim 6, wherein the membrane layer is coupled to the first knit zone, the second knit zone, and the third knit zone.

8. The article of footwear of claim 1 further comprising:

a vamp assembly secured to the upper and including a toe portion, a vamp body portion, and a tongue portion.

9. The article of footwear of claim 8, wherein the toe portion comprises leather and is stitched to the vamp body portion.

10. The article of footwear of claim 8, wherein the vamp assembly is configured to allow laces to be thread underneath the tongue portion of the vamp assembly.

11. The article of footwear of claim 1, wherein the first knit zone comprises a first thread having a first color, the second knit zone comprises a second thread having a second color, and the third knit zone comprises a third thread having a third color, and wherein each of the first color, the second color, and the third color are different from one another.

12. The article of footwear of claim 1, wherein the heel element is a single piece of leather.

13. The article of footwear of claim 1, wherein the first knit zone comprises a first thread having a first diameter, the second knit zone comprises a second thread having a second diameter, and the third knit zone comprises a third thread having a third diameter, and wherein each of the first diameter, the second diameter, and the third diameter are different.

14. The article of footwear of claim 13, wherein the first diameter is smaller than the second diameter, and the second diameter is smaller than the third diameter.

15. The article of footwear of claim 13, wherein the diameter of the first thread in the first knit zone is between about 0.01 millimeters and about 8.00 millimeters.

16. The article of footwear of claim 13, wherein the diameter of the second thread in the second knit zone is between about 1.0 millimeter and about 15 millimeters.

17. The article of footwear of claim 13, wherein the diameter of the third thread in the third knit zone is between about 1.0 millimeter and about 20 millimeters.

18. An article of footwear defining a forefoot region, a midfoot region, a heel region, a medial side, and a lateral side, the article of footwear comprising:

an upper with an outer surface;

a heel element secured to the upper proximate to a heel region; and a sole structure, wherein the upper includes a knit fabric forming a first knit zone having a first elasticity, a second knit zone having a second elasticity, and a third knit zone having a third elasticity, wherein the first knit zone is disposed within the forefoot region, the second knit zone is disposed within the midfoot region, and the third knit zone is disposed within the heel region, and wherein the second elasticity is greater than the third elasticity, wherein the first knit zone and the second knit zone are defined by a webbing that forms a warp knit, the warp knit including a plurality of peaks and troughs, and wherein the plurality of peaks and troughs of a single line of webbing are closer together in the second knit zone than in the first knit zone.

19. An article of footwear defining a forefoot region, a midfoot region, a heel region, a medial side, and a lateral side, the article of footwear comprising:

an upper with an outer surface;

a heel element secured to the upper proximate to a heel region; and a sole structure, wherein the upper includes a knit fabric having a first knit zone having a first elasticity, a second knit zone having a second elasticity, a third knit zone having a third elasticity, and a membrane layer affixed to the knit fabric, wherein each of the first elasticity, the second elasticity, and the third elasticity are different, wherein the first knit zone is disposed within the forefoot region, the second knit zone is disposed within the midfoot region, and the third knit zone is disposed within the heel region, wherein the first knit zone comprises a first thread having a first diameter, the second knit zone comprises a second thread having a second diameter, and the third knit zone comprises a third thread having a third diameter, and wherein the first diameter is smaller than the second diameter, and the second diameter is smaller than the third diameter.

* * * * *